US007618134B2

(12) United States Patent
Kuriki

(10) Patent No.: US 7,618,134 B2
(45) Date of Patent: Nov. 17, 2009

(54) IMAGE RECORDING APPARATUS

(75) Inventor: Kumiko Kuriki, Toyohashi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 535 days.

(21) Appl. No.: 11/615,193

(22) Filed: Dec. 22, 2006

(65) Prior Publication Data

US 2007/0146418 A1 Jun. 28, 2007

(30) Foreign Application Priority Data

Dec. 26, 2005 (JP) ..... 2005-373173

(51) Int. Cl.
*B41J 2/175* (2006.01)
*B41J 23/00* (2006.01)

(52) U.S. Cl. ..... 347/85; 347/37

(58) Field of Classification Search ..... 347/37, 347/85

See application file for complete search history.

(56) References Cited

U.S. PATENT DOCUMENTS

| | | | | |
|---|---|---|---|---|
| 5,751,300 | A * | 5/1998 | Cowger et al. | 347/6 |
| 6,220,700 | B1 * | 4/2001 | Haigo | 347/85 |
| 2006/0192833 | A1 | 8/2006 | Samoto et al. | |

FOREIGN PATENT DOCUMENTS

| | | | |
|---|---|---|---|
| JP | 2004-167737 | A | 6/2004 |
| JP | 2005-035033 | A | 2/2005 |
| JP | 2005-088524 | A | 4/2005 |
| JP | 2006-231819 | A | 9/2006 |

* cited by examiner

*Primary Examiner*—An H Do
(74) *Attorney, Agent, or Firm*—Baker Botts L.L.P.

(57) ABSTRACT

A carriage includes a carriage body and a carriage cover. The carriage body has a joint portion to which ink tubes are connected while being arranged in a lateral direction, and a flat plane formed from the joint portion in an extending direction of the ink tubes and carrying the ink tubes slidably in the lateral direction. The carriage cover has a pressing member attached on an upper side of the carriage body and maintaining the ink tubes in an arrangement state in the lateral direction. The ink tubes are pinched between the carriage cover and the flat plane slidably in the lateral direction.

14 Claims, 15 Drawing Sheets

IMAGE RECORDING APPARATUS

CROSS-REFERENCE TO RELATED APPLICATION

This Nonprovisional application claims priority under 35 U.S.C, §119(a) on Patent Application No. 2005-373173 filed in Japan on Dec. 26, 2005, the entire contents of which are hereby incorporated by reference.

BACKGROUND OF THE INVENTION

1. Field of the Invention

The present invention relates to an image recording apparatus having ink tubes for supplying ink connected to a carriage so as to follow a reciprocating motion of the carriage, wherein the carriage carries a recording head for recording an image on a recording medium and reciprocates in a direction crossing a moving direction of the recording medium.

2. Description of Related Art

As the image recording apparatus for performing image recording on the recording medium by ejecting ink based on an input signal, conventionally known apparatus is the one that conducts ink to an actuator of the recording head and pressurizes and ejects the ink in accordance with the input signal by using deflection of the actuator such as a piezoelectric element and electrostriction element, or boiling of the ink that locally occurs due to a heating element.

For example, in an image recording apparatus called a serial printer, a recording head such as aforementioned is carried on the carriage that reciprocates in a direction crossing a conveying direction of the recording medium. Then, every time the recording medium is conveyed by a predetermined line feed width, the carriage reciprocates to record an image. When the recording head and an ink cartridge are disposed at separated positions, the recording head and the ink cartridge are connected by a flexible ink tube to allow the ink to flow therethrough. The ink tube has a sufficient length, thereby allowing the ink tube to follow the reciprocating motion of the carriage so as not to interrupt the reciprocating motion of the carriage, and is disposed between the recording head and the ink cartridge, in a state of being flexed in an approximately U-shape (see, for example, Japanese Patent Application Laid-Open No. 2005-35033).

When ink of plural colors such as cyan, magenta, yellow and black are supplied to the recording head so as to be adaptable to full-color printing, the ink tube is provided for each ink color. These plural ink tubes are fixed to the carriage, so as not to move randomly when they change a posture by following the movement of the carriage. For example, according to the aforementioned Japanese Patent Application Laid-Open No. 2005-35033, plural ink tubes are inserted into an annular holding portion provided on an upper surface of the carriage, fixed thereto, so as to integrally extend in a predetermined direction from the carriage.

BRIEF SUMMARY OF THE INVENTION

An end portion of a carriage side of an ink tube is connected to a joint portion provided on the carriage. In a case where large load concentrates on the joint portion by its own weight of the ink tube in which ink flows, or when the ink tube changes its posture by following a reciprocating motion of the carriage, breakdown of the joint portion or removal of the ink tube occurs to cause ink leakage. Accordingly, preferably, a support member for supporting the ink tube is provided in the vicinity of the joint portion, and large load is thereby not allowed to concentrate on the joint portion. Also, since the ink tube changes its posture when following the movement of the carriage, the ink tube extending from the joint portion needs to have a suitable degree of freedom in its posture change, and also the posture change of the ink tube must be restricted to a predetermined range to prevent the ink tube from being bent.

If the aforementioned support member is provided in the carriage, the support member needs to be rigid enough to bear a considerable weight of the ink tube. Also, preferably, assembly of the support member and the ink tube is easy.

There is a demand for making an image recording apparatus thinner, that is, reducing a dimension in a vertical direction. Therefore, when a plurality of ink tubes are arranged in the vertical direction in the carriage, a space necessary for arranging the ink tubes above the carriage becomes larger in the vertical direction. In order to make this space smaller, it is preferable to connect the plurality of ink tubes to the carriage, in a state of being arranged in a lateral direction with respect to the carriage. However, it is necessary to maintain such an arrangement of the plurality of ink tubes in the lateral direction even when the posture change occurs by following the reciprocating motion of the carriage.

In view of the above-described problem, the present invention is provided, and an object of the present invention is to support a plurality of ink tubes that follows a movement of a carriage in a state adapted to a posture change, in an image recording apparatus having a carriage that reciprocates in a direction crossing a conveying direction of a recording medium.

In addition, another object of the present invention is to simplify assembly of ink tubes in the carriage.

Also, another object of the present invention is to maintain the ink tubes in a state of being arranged in a lateral direction in the carriage.

The image recording apparatus according to the present invention is an image recording apparatus that comprises: an apparatus body; a recording head for recording an image by ejecting ink droplets to a recording medium that is conveyed in a predetermined conveying direction; a carriage carrying the recording head thereon and reciprocating inside the apparatus body in a direction crossing the conveying direction; and a plurality of flexible ink tubes, for supplying ink to the recording head, whose one end portions are fixed to the carriage and the other end portions are fixed to a fixing portion of an apparatus body such that the ink tubes extend from the carriage and from the fixing portion in one direction along the reciprocating direction of the carriage and form, at their intermediate portions, a curved portion reversing from one direction to the other direction along the reciprocating direction of the carriage. Such image recording apparatus according to the present invention is characterized in that the carriage includes: a carriage body having: a joint portion to which the plurality of ink tubes are connected in a state of being arranged in a first direction parallel to the conveying direction and the reciprocating direction of the carriage; and a flat plane protruding in an extending direction of the plurality of ink tubes from the joint portion, and carrying extending portions of the plurality of ink tubes from the joint portion slidably in the first direction. Further more, the image recording apparatus according to the present invention is characterized in that the carriage includes a carriage cover having a pressing member for maintaining an arrangement state of the extending portions of the plurality of ink tubes in the first direction, by pinching the extending portions of the plurality of ink tubes against the flat plane slidably in the first direction.

The above and further objects and features of the invention will more fully be apparent from the following detailed description with accompanying drawings.

DETAILED DESCRIPTION OF THE PRESENT INVENTION

Preferred embodiments of the present invention will be explained with reference to the drawings as needed. Note that this embodiment is only an example of the present invention, and needless to say, the embodiment can be suitably changed in a scope not departing from the spirits of the present invention.

Figure 1:
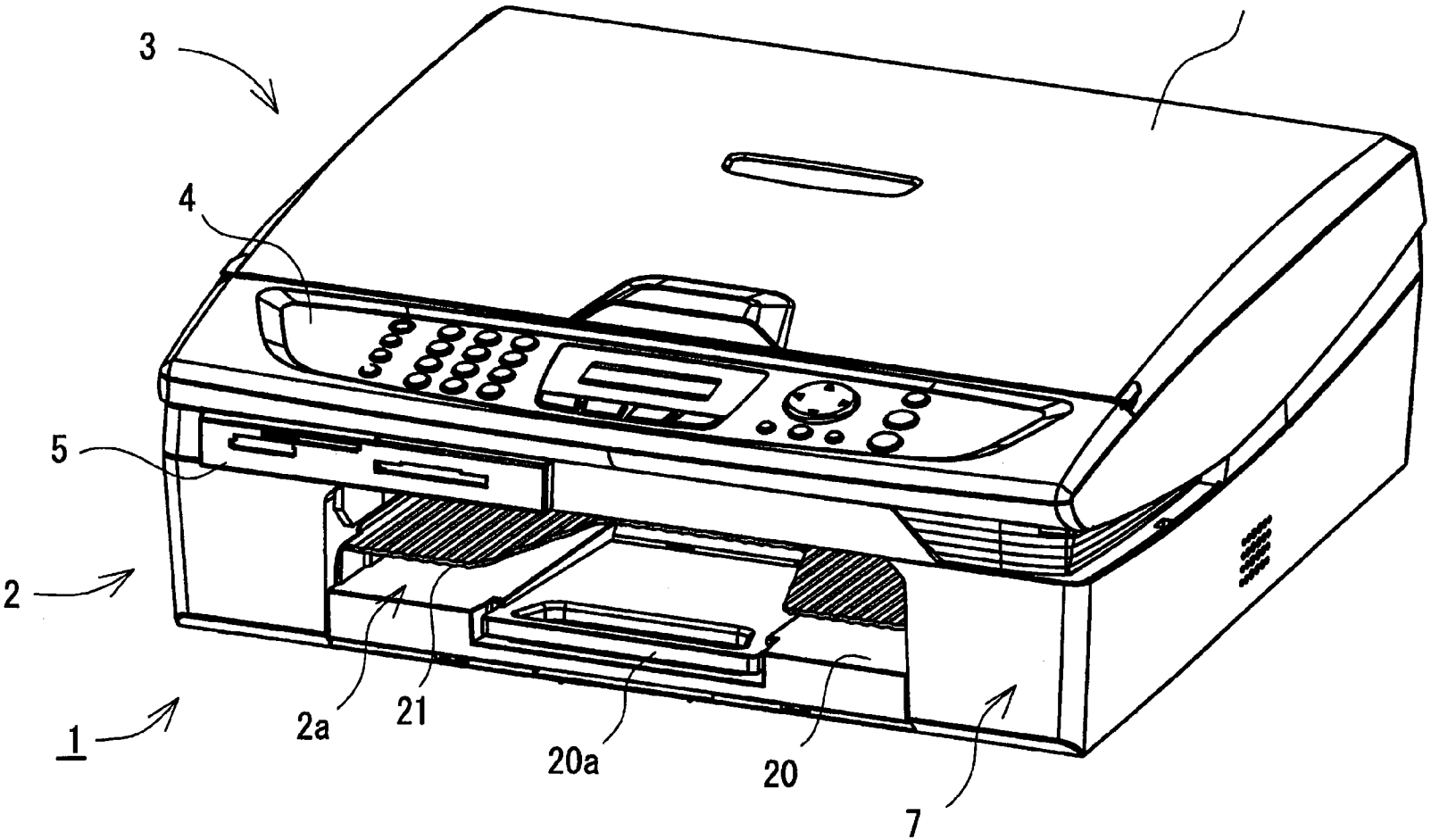
FIG. 1 is a schematic perspective view showing an outer configuration of a multi-function device according to an embodiment of an image recording apparatus of the present invention.
Figure 2:
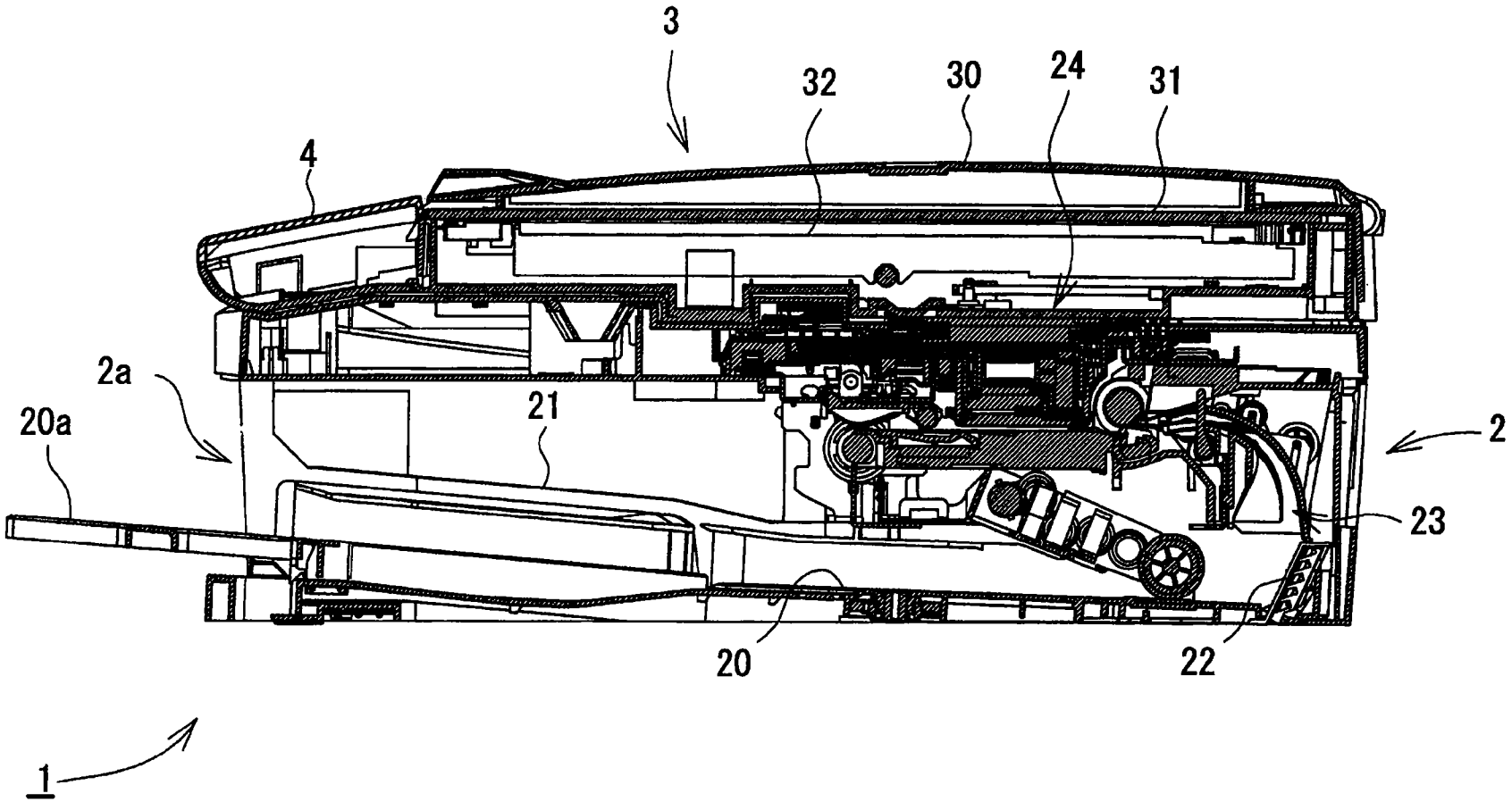
FIG. 2 is a schematic vertical sectional view showing an internal configuration of the multi-function device according to the embodiment of the image recording apparatus of the present invention.

FIG. 1 is a schematic perspective view showing an outer configuration of a multi-function device (MFD) to which an image recording apparatus according to an embodiment of the present invention is adopted. Also, FIG. 2 is a schematic vertical sectional view showing an internal configuration of the MFD to which the image recording apparatus according to the embodiment of the present invention is adopted.

An MFD 1 is integrally provided with a printer unit 2 in a lower portion and a scanner unit 3 in an upper portion thereof, and has functions such as a printer function, scanner function, copying function and a facsimile function. The printer unit 2 in the MFD 1 corresponds to an image recording apparatus of the present invention. Accordingly, the function other than the printer function is optional function, and, for example, the image recording apparatus of the present invention may be realized as a printer of a single function not having the scanner unit 3, and not having the scanner function or copying function.

The printer unit 2 of the MFD 1 is connected to an external information apparatus mainly such as a computer. The printer unit 2 records an image and/or document on a recording paper (recording medium), based on print data including image data and/or document data transmitted from the computer. In addition, the MFD 1 is capable of recording on the recording paper the image data outputted from a digital camera and the like when the digital camera and the like is connected thereto, and recording on the recording paper the image data and the like stored in the storage medium such as a memory card and the like when each kind of the storage medium is loaded thereto.

As shown in FIG. 1, the MFD 1 has a substantially rectangular parallelpiped outer shape, i.e. a wide and thin shape wherein a lateral width and depth are larger than a height, and the printer unit 2 is incorporated in a lower portion. An opening 2*a* is opened in a front face of the printer unit 2. A paper feed tray 20 and a paper discharge tray 21 are provided in upper and lower stages in the opening 2*a*. The recording paper as the recording medium of each kind of sizes such as the B5 size smaller than the A4 size, and post card size, is stored in the paper feed tray 20. As shown in FIG. 2, in the paper feed tray 20, a tray surface is expanded by pulling out a slide tray 20*a* as needed. In this case, for example, the recording paper of a legal size can be stored. The recording paper stored in the paper feed tray 20 is fed to an inside of the printer unit 2, thereby recording a desired image, and is discharged to the paper discharge tray 21.

The scanner unit 3 is incorporated in an upper portion of the MFD 1, and is configured as a so-called flat bed scanner. As shown in FIG. 1 and FIG. 2, a platen glass 31 and an image sensor 32 are provided below a document cover 30 which can be freely opened and closed, and is provided as a top board of the MFD 1. A document from which an image is to be read is placed on the platen glass 31. The image sensor 32 which can be reciprocally moved in a width direction of the MFD 1 (direction vertical to a paper surface of FIG. 2), with a depth direction of the MFD 1 (right-left direction of FIG. 2) set as a main scanning direction is provided below the platen glass 31.

An operation panel 4 for operating the printer unit 2 or the scanner unit 3 is provided at a front upper portion of the MFD 1. The operation panel 4 is composed of each kind of operation button and a liquid crystal display. The MFD 1 is operated based on an operation instruction given from the operation panel 4. When the MFD 1 is connected to the external computer, the MFD 1 is also operated based on an instruction transmitted from the computer through a printer driver or a scanner driver. A slot unit 5 is provided at a front upper left portion of the MFD 1. Each kind of small-sized memory card as the storage medium can be loaded in the slot unit 5. When a user performs a predetermined operation to the operation panel 4, the image data stored in the small-sized memory card loaded in the slot unit 5 is read. Information relating to the image data thus read is displayed on the liquid crystal display of the operation panel 4, and therefore based on this display, the user can record a desired image on the recording paper by the printer unit 2.

Hereunder, an explanation is given to an internal configuration of the MFD 1, particularly the configuration of the printer unit 2, with reference to FIG. 2 to FIG. 15. As described above, FIG. 2 is a schematic vertical sectional view showing an internal configuration of the MFD to which the image recording apparatus according to the embodiment of the present invention is adopted.

As shown in FIG. 2, the paper feed tray 20 is provided on the bottom side of the MFD 1. A separation tilting plate 22 is provided in a depth side of the paper feed tray 20. The separation tilting plate 22 separates the recording papers sent from the paper feed tray 20 in a mutually overlapped state, and guides upward only the uppermost recording paper. A paper conveying path 23 runs upward from the separation tilting plate 22, and is curved toward the front side of the MFD 1. Namely, the paper conveying path 23 runs from a backside to a front side of the MFD 1, and leads to the paper discharge tray 21 through an image recording unit 24. Accordingly, the recording paper stored in the paper feed tray 20 is guided by the paper conveying path 23 so as to make a U-turn upward from below, and reaches the image recording unit 24. Then, the recording paper already recorded the image thereon by the image recording unit 24 is discharged to the paper discharge tray 21.

Figure 3:
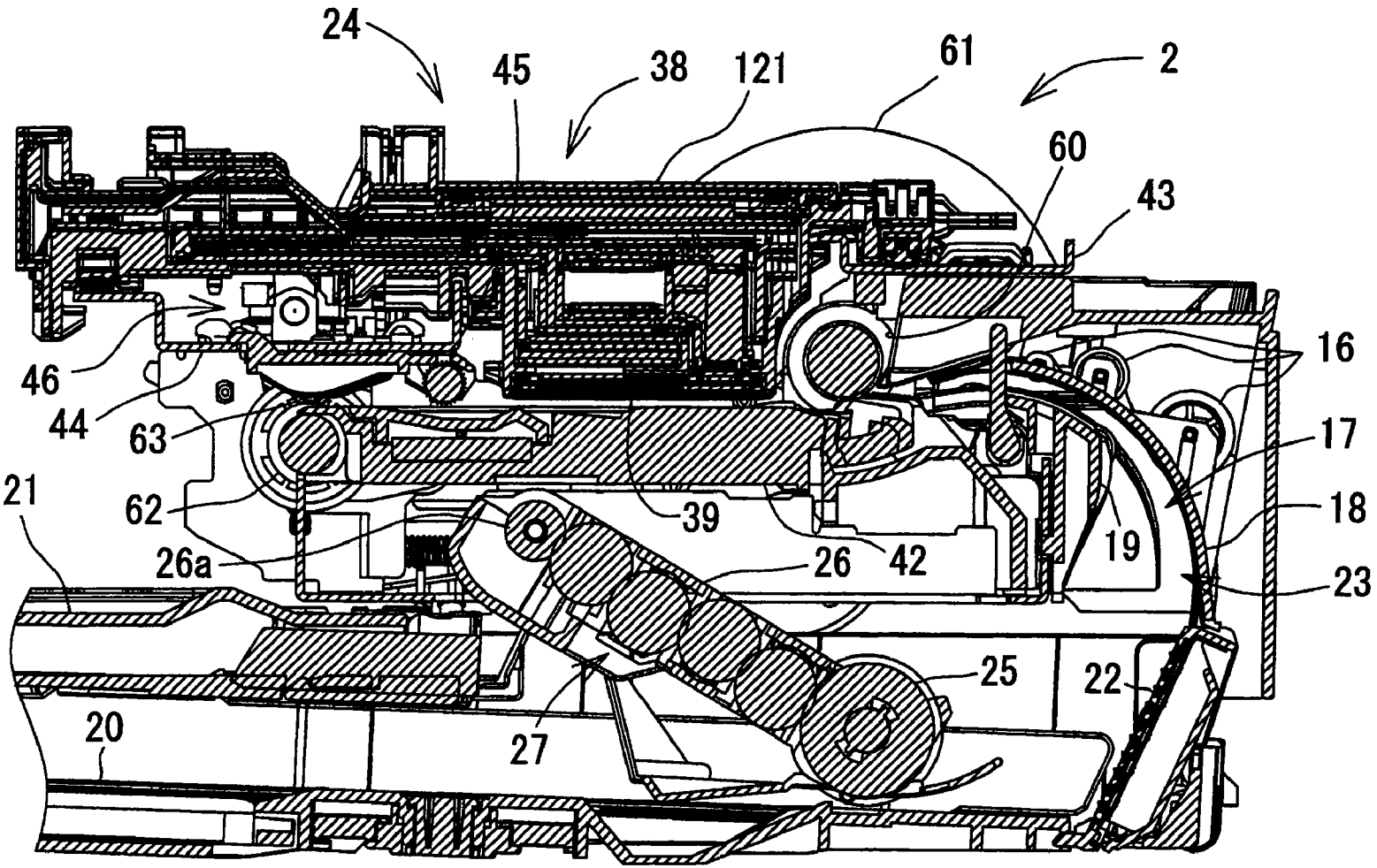
FIG. 3 is a partially expanded sectional view showing a configuration of an essential portion of a printer unit according to the embodiment of the image recording apparatus of the present invention.

FIG. 3 is a partially expanded sectional view showing a configuration of an essential portion of the printer unit according to the embodiment of the image recording apparatus of the present invention.

As shown in FIG. 3, a paper feed roller 25 for feeding the recording paper placed on the paper feed tray 20 to the paper conveying path 23 is provided above the paper feed tray 20. The paper feed roller 25 is pivotally supported by a tip end of a paper feed arm 26. The paper feed roller 25 is rotated by transmitting driving force of an LF motor 71 described below (see FIG. 9) through a driving force transmission mechanism 27 configured by meshing a plurality of gears.

The paper feed arm 26 is provided so as to make a base shaft 26*a* thereof as a rotary shaft. By rotating with the base shaft 26*a* as a rotation center, the paper feed arm 26 moves vertically so as to be brought into contact with and separated from the paper feed tray 20. As shown in FIG. 3, the paper feed arm 26 comes into contact with the paper feed tray 20 by its own weight or by being urged with a spring or the like so as to move rotationally to the downside. However, when the paper feed tray 20 is inserted into or pulled out, the paper feed arm 26 can retreat to the upside. By a rotational movement of the paper feed arm 26 to the downside, the paper feed roller 25 pivotally supported to the tip end of the paper feed arm 26 is brought into a pressure contact with the recording paper on the paper feed tray 20. In this state, when the paper feed roller 25 is rotated, by a frictional force between a roller surface of the paper feed roller 25 and the recording paper, the uppermost recording paper is sent to the separation tilting plate 22. The recording paper is guided upward, with its front end come into contact with the separation tilting plate 22, and is sent into the paper conveying path 23. When the uppermost recording paper is sent by the paper feed roller 25, the recording paper just thereunder is sometimes sent accordingly by an action of a friction or static electricity (sent in a mutually overlapped state). However, the recording paper thus sent in a mutually overlapped state is restrained by making contact with the separation tilting plate 22, thus sending only the uppermost recording paper.

The paper conveying path 23 is composed of an outside guide surface and an inside guide surface facing each other with a predetermined distance, other than a portion in which the image recording unit 24 and the like is disposed. For example, a curved portion 17 of the paper conveying path 23 on the backside of the MFD 1 is configured by fixing an outside guide member 18 and an inside guide member 19 to a body frame. On the paper conveying path 23, particularly at a portion where the paper conveying path 23 is curved, rollers 16 whose axial directions are made to be a width direction of the paper conveying path 23 are rotatably provided, so that surfaces of the rollers are exposed to the outside guide surface. By each roller 16, the recording paper is smoothly conveyed in a slide contact with a guide surface even in the portion where the paper conveying path 23 is curved.

As shown in FIG. 3, the image recording unit 24 is provided on the paper conveying path 23. The image recording unit 24 comprises a carriage 38 carrying thereon an ink jet recording head 39 reciprocating in the main scanning direction. To the ink jet recording head 39, each color ink such as cyan (C), magenta (M), yellow (Y), and black (Bk) is supplied from each ink cartridge disposed in the MFD 1 independently of the ink jet recording head 39 through each ink tube 41 (ink tube, see FIG. 4). During the reciprocating motion of the carriage 38 by selectively ejecting each color ink from the ink jet recording head 39 as minute ink droplets, an image is recorded on the recording paper conveyed on a platen 42. Note that the ink cartridge is not shown in FIG. 3 and FIG. 4.

Figure 4:
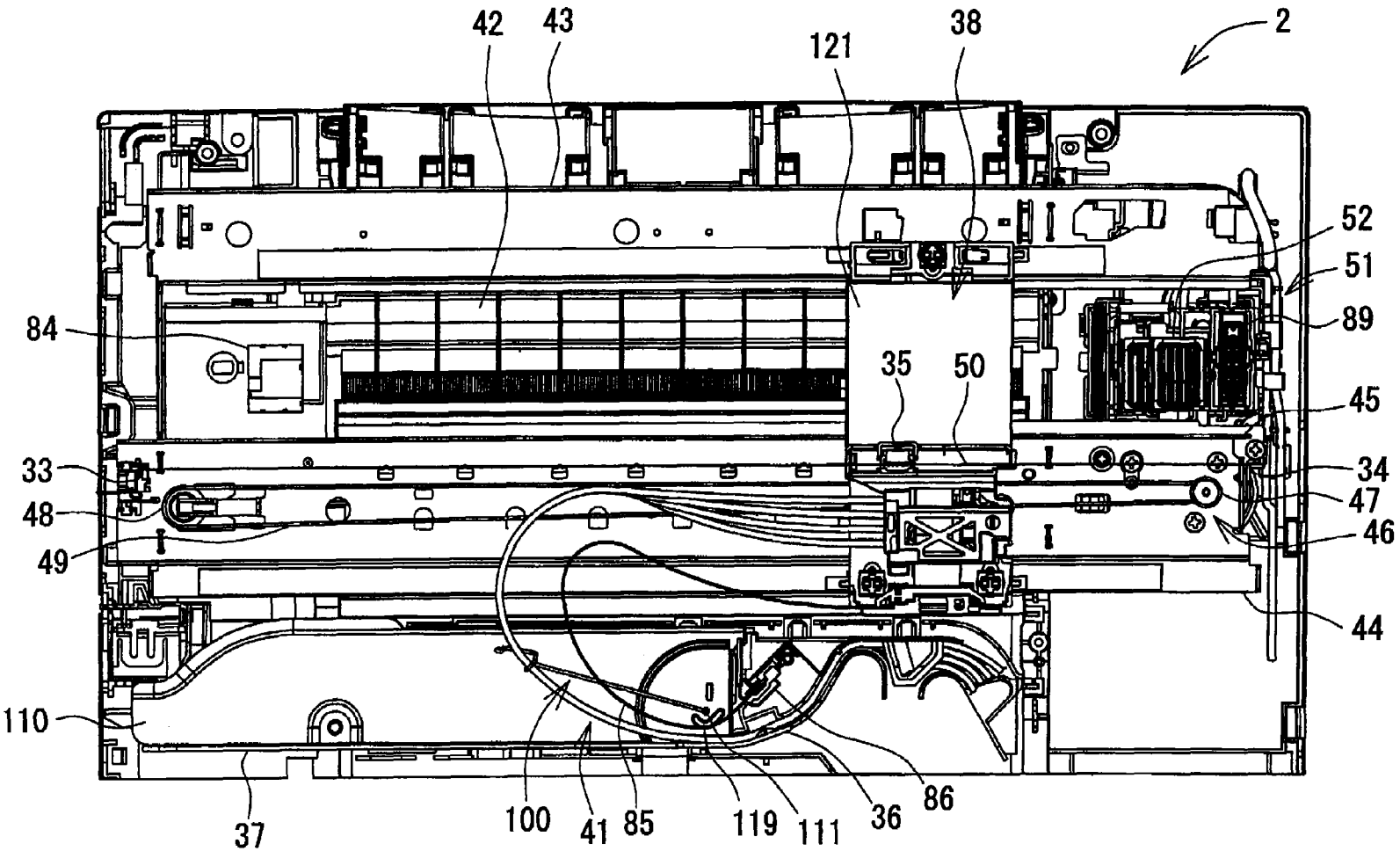
FIG. 4 is a plan view showing the configuration of the essential portion of the printer unit according to the embodiment of the image recording apparatus of the present invention.

FIG. 4 is a plan view showing the configuration of the essential portion of the printer unit according to the embodiment of the image recording apparatus of the present invention, and mainly showing the configuration of the apparatus from approximately the center of the printer unit to the backside of the apparatus.

As shown in FIG. 4, above the paper conveying path 23, a pair of guide rails 43 and 44 are extended in a direction (right-left direction in FIG. 4) crossing the conveying direction of the recording paper (hereunder called as a paper conveying direction), while being separated at a predetermined distance in the paper conveying direction (direction from upside to downside in FIG. 4). Note that in this embodiment, the direction of the pair of guide rails 43 and 44 crossing the paper conveying direction corresponds to a substantially orthogonal direction, and therefore an explanation is given hereunder that the pair of guide rails 43 and 44 are orthogonal to the paper conveying direction.

The guide rails 43 and 44 are provided in a casing of the printer unit 2, and constitute a part of a frame for supporting each member constituting the printer unit 2. The carriage 38 is placed slidably in the direction orthogonal to the paper conveying direction in a manner of bridging over the guide rails 43 and 44. Thus, by arranging the guide rails 43 and 44 side by side almost in parallel to the surface of the recording paper, at separated positions in the paper conveying direction, a height of the printer unit 2 is lessened, thus making it possible to form the apparatus thinner.

The guide rail 43 disposed on an upstream side in the paper conveying direction is a plate like member whose length in a width direction (right-left direction in FIG. 4) of the paper conveying path 23 is longer than a reciprocating range of the carriage 38. The guide rail 44 disposed on a downstream side in the paper conveying direction is the plate like member whose length in the width direction of the paper conveying path 23 is almost the same as the length of the guide rail 43.

An end portion of the carriage 38 on the upstream side of the paper conveying direction is placed on the guide rail 43, and an end portion of the same on the downstream side in the paper conveying direction is placed on the guide rail 44. Accordingly, the carriage 38 can slidably move in a longitudinal direction (right-left direction in FIG. 4) of the guide rails 43 and 44. An edge portion 45 of the guide rail 44 on the upstream side in the paper conveying direction is bent approximately at right angle upward. The carriage 38 carried on the guide rails 43 and 44 slidably pinches the edge portion 45 of the guide rail 44 by a pinching member such as a pair of rollers. Thus, the carriage 38 is positioned in the paper conveying direction, and can slide in a direction orthogonal to the paper conveying direction. Namely, the carriage 38 is slidably carried on the guide rails 43 and 44, and reciprocates in the direction orthogonal to the paper conveying direction while being positioned by the edge portion 45 of the guide rail 44 as a reference. In addition, although not shown, a lubricant agent such as grease is applied to the edge portion 45 so that the carriage 38 can smoothly slide.

A belt driving mechanism 46 is disposed on the upper surface of the guide rail 44. The belt driving mechanism 46 is so constituted that an endless circular timing belt 49 having teeth on its inside is wound between a driving pulley 47 and a driven pulley 48 each being provided on the guide rail 44 at both end portions in the width direction of the paper conveying path 23. A driving force is inputted in a shaft of the driving pulley 47 from a CR motor 73 (see FIG. 9) described later. Accordingly, by a driving force from the CR motor 73, the driving pulley 47 is rotated, and the timing belt 49 carries out circular motion. Note that the timing belt 49 is not limited to the endless circular type, but may be constituted so as to firmly fix both end portions of a limited-length belt to the carriage 38.

At the bottom side, the carriage 38 is firmly secured to the timing belt 49. Accordingly, in accordance with a circular motion of the timing belt 49, the carriage 38 reciprocates on the guide rails 43 and 44, with the edge portion 45 as a reference. Since the ink jet recording head 39 is carried on such a carriage 38, as a result, the ink jet recording head 39 reciprocates, in the width direction of the paper conveying path 23 as the main scanning direction.

An encoder strip 50 of a linear encoder 77 (see FIG. 9) is disposed in the guide rail 44. The encoder strip 50 is a strip member composed of a transparent resin. A pair of support portions 33 and 34 are formed on both end portions of the guide rail 44 in the width direction (reciprocating direction of the carriage 38), so as to stand upright from the upper surface of the guide rail 44. The encoder strip 50 is laid out over along the edge portion 45 in a state where the both end portions thereof are engaged with the support portions 33 and 34, respectively. Note that although not shown, a plate spring is provided at one of the support portions 33 and 34, and by this plate spring, an end portion of the encoder strip 50 is engaged. This plate spring prevents slacking of the encoder strip 50 by acting a tensile force on the encoder strip 50 in the longitudinal direction. When an external force acts on the encoder strip 50, the encoder strip 50 flexes by elastically deforming of the plate spring.

The encoder strip 50 is formed with a pattern in which a light transmitting portion for transmitting light and a light shielding portion for intercepting light are alternately arranged in the longitudinal direction at a predetermined pitch. At a position corresponding to the encoder strip 50 on the upper surface of the carriage 38, an optical sensor 35, which is a transmission type sensor, is provided. The optical sensor 35 reciprocates along the longitudinal direction of the encoder strip 50 together with the carriage 38, and detects the pattern of the encoder strip 50 during reciprocating motion. On the ink jet recording head 39, a head control substrate 40 (see FIG. 12) for controlling ejecting of the ink is provided. The head control substrate 40 outputs a pulse signal based on a detection signal of the optical sensor 35, and based on the pulse signal thus outputted, the position of the carriage 38 is determined and the reciprocating motion of the carriage 38 is controlled. Note that in FIG. 4, since the head control substrate 40 is covered with a carriage cover 121 of the carriage 38, it is not shown.

As shown in FIG. 3 and FIG. 4, the platen 42 is disposed on the lower side of the paper conveying path 23 facing the ink jet recording head 39. The platen 42 is disposed covering the center portion where the recording paper passing within a range of reciprocating motion of the carriage 38. A width of the platen 42 is sufficiently larger than a maximum width of the recording paper that can be conveyed. Therefore, both side edges of the recording paper always pass over the platen 42.

As shown in FIG. 4, in a range where the recording paper does not pass, that is, outside an image recording range by the ink jet recording head 39, maintenance units such as a purge mechanism 51, a waste ink tray 84 and the like are disposed. The purge mechanism 51 sucks and removes bubble and/or foreign materials from nozzles 53 (see FIG. 7) of the ink jet recording head 39. The purge mechanism 51 is composed of a cap 52 covering the nozzles 53 of the ink jet recording head 39, a pump mechanism connected to the ink jet recording head 39 through the cap 52, and a moving mechanism for making the cap 52 come into contact with or separated from the nozzles 53 of the ink jet recording head 39. Note that in FIG. 4, the pump mechanism and the moving mechanism are located below the guide rail 44, and therefore they are not shown in the figure. At the time of suction and removal of the bubble and the like from the ink jet recording head 39, the carriage 38 moves so that the ink jet recording head 39 is located above the cap 52. In this state, the cap 52 moves upward so as to seal the nozzles 53 on the lower surface of the ink jet recording head 39, and is glued thereto. By making the inside of the cap 52 be a negative pressure by the pump mechanism, the ink is sucked from the nozzles 53 of the ink jet recording head 39. The bubble and foreign materials in the nozzles 53 are sucked and removed together with the ink.

The waste ink tray 84 is provided for receiving the ink that is idly ejected from the ink jet recording head 39, which is called flushing. The waste ink tray 84 is formed on the upper surface of the platen 42, in the range of the reciprocating motion of the carriage 38, and outside the image recording range. Note that a felt is laid down in the waste ink tray 84. The flushed ink is sucked into this felt and held thereon. By these maintenance units, maintenance such as a removal of the bubble and mixed color ink in the ink jet recording head 39 and drying prevention is performed.

As shown in FIG. 1, a door 7 is provided on the front surface of the casing of the printer unit 2 so as to be freely opened. When the door 7 is opened, a cartridge receiving portion is exposed on the front side of the apparatus, so that the ink cartridge can be inserted thereinto and pulled out therefrom. The cartridge receiving portion is, although not shown, divided into four container chambers corresponding to the ink cartridge, and each container chamber contains the ink cartridge storing each color ink of cyan, magenta, yellow, and black. Four ink tubes 41 corresponding to each color are laid out to the carriage 38 from the cartridge receiving portion. To the ink jet recording head 39 carried on the carriage 38, each color ink is supplied from the ink cartridge attached to the cartridge receiving portion, through each ink tube 41.

Each ink tube 41 is made of synthetic resin, and has flexibility of easily flexing by sufficiently following the reciprocating motion of the carriage 38. Each ink tube 41 led from the cartridge receiving portion is pulled out up to the vicinity of the center portion along the width direction (right-left direction) of the apparatus, and fixed to a fixing portion of the apparatus body. Specifically, a fixing clip 36 is fixed to the apparatus body, and by this fixing clip 36, each ink tube 41 is fixed to the apparatus body once. Each ink tube 41 has, between a portion fixed by the fixing clip 36 and a portion connected to the carriage 38, a portion not fixed to the apparatus body, and thus can be freely flexed. Such a portion of each ink tube 41 capable of freely flexing changes the posture, specifically, is curved while freely changing a curvature by following the reciprocating motion of the carriage 38. Note that in FIG. 4, the ink tubes 41 extending from the portion fixed by the fixing clip 36 toward the cartridge receiving portion of the apparatus body are omitted.

As shown in FIG. 4, the ink tubes 41 are laid out, so that the portion from the fixing clip 36 to the carriage 38 forms a curved portion reversing from one direction to the other along a reciprocating direction of the carriage 38. In other words, the ink tubes 41 are laid out so that an intermediate portion in plan view forms an approximately a U-shape. Four ink tubes 41 are arranged in a lateral direction along the paper conveying direction with respect to the carriage 38, more specifically, arranged in a direction parallel to the paper conveying direction and to the reciprocating direction of the carriage 38 (in a substantially horizontal direction when the apparatus body is set on a horizontal plane), and are extended to one of the reciprocating direction of the carriage 38 (left side direction in FIG. 4). Note that the direction in which the aforementioned four ink tubes 41 are arranged in the carriage 38 is a first direction.

Meanwhile, at the fixing clip 36, the four ink tubes 41 are fixed while being arranged in a state of being stacked in a vertical direction (when the apparatus body is set on the horizontal plane, in a direction substantially perpendicular to the horizontal direction). The fixing clip 36 is a member with upwardly opened section formed into a U-shape, and by inserting each ink tube 41 downward from upside of the opening, the four ink tubes 41 stacked in the vertical direction are integrally pinched by the fixing clip 36. Namely, the four ink tubes 41 are curved as an integral body into an approximately U-shape in plan view of the four ink tubes 41, while being mutually twisted so that the arrangement in the lateral direction changes to the arrangement in the vertical direction in the intermediate portion, from the carriage 38 toward the fixing clip 36. As a result, on the side of the carriage 38, space-saving above the carriage 38 is attained, and on the side of the fixing clip 36 of the apparatus body, space-saving in the paper conveying direction is attained.

The four ink tubes 41 have approximately the same length from the carriage 38 to the fixing clip 36. In the carriage 38, a first ink tube 41 disposed on the uppermost stream side in the paper conveying direction is also disposed on the uppermost side in the fixing clip 36. Then, a second ink tube 41 disposed on the upstream side next to the first ink tube 41 is also disposed on the lower side next to the first ink tube 41 in the fixing clip 36. In the same way, the ink tubes are sequentially arranged from the ink tube 41 on the upstream side in the paper conveying direction toward the ink tube 41 on the downstream side in the carriage 38, and sequentially arranged from the uppermost side to the lowermost side in the fixing clip 36. As described above, each ink tube 41 has approximately the same length. Accordingly, in accordance with an arrangement order in the carriage 38, a center of the curved portion of approximately U-shape of each ink tube 41 is deviated in the paper conveying direction. As a result, on the side of the carriage 38 of the curved portion, the four ink tubes 41 are twisted so as to align in an oblique direction from upside toward downside. Therefore, interference between ink tubes 41 is reduced when the posture is changed by following the reciprocating motion of the carriage 38. Note that in this embodiment, a configuration having four ink tubes 41 is explained. However, even when the number of the ink tubes 41 are further increased, similarly, the ink tubes may be sequentially disposed from the ink tube 41 on the upstream side in the paper conveying direction in the carriage 38 to the upside of the fixing clip 36. A fixing configuration of the ink tubes 41 in the carriage 38 will be described later.

Signals for recording and the like are transmitted to a head control substrate 40 of the ink jet recording head 39 from a main substrate constituting a control unit 64 (see FIG. 9) through a flat cable 85. Note that the main cable is disposed on the front side of the apparatus (on the front side in FIG. 4), but is not shown in FIG. 4. The flat cable 85 is a thin band-shaped cable insulated by covering a plurality of conductive wires for transmitting an electric signal with a synthetic resin film such as polyester film, and electrically connects the main substrate and the head control substrate 40.

The flat cable 85 has a flexibility so as to sufficiently follow the reciprocating motion of the carriage 38. As shown in FIG. 4, the flat cable 85 is laid out, so that the portion from a connection portion to the carriage 38 to the portion fixed by the fixing clip 86 secured to the apparatus body can form the curved portion for reversing from one direction to the other along the reciprocating direction of the carriage 38. In other words, the flat cable 85 is laid out so as to form approximately a U-shape in plan view, with a front and rear surfaces of the thin band-shape set as the vertical direction. Namely, perpendicular lines to the front and rear surfaces of the flat cable 85 are directed to the lateral direction, and the front and rear surfaces extend in the vertical direction. Also, the direction of extending the flat cable 85 from the carriage 38 and the direction of extending the ink tubes 41 from the carriage are the same direction along the reciprocating direction of the carriage 38.

One end side of the flat cable 85 fixed to the carriage 38 is electrically connected to the head control substrate 40 mounted on the carriage 38. The other end side of the flat cable 85 fixed to the fixing clip 86 is further extended and electrically connected to the main substrate. The portion where the flat cable 85 is curved in an approximately U-shape is fixed to none of the members, and in the same way as the ink tubes 41, the posture change occurs by following the reciprocating motion of the carriage 38. The ink tubes 41 and the flat cable 85 that thus change posture by following the reciprocating motion of the carriage 38 are supported by a rotating support member 100, so as not to hang downward.

Figure 5:
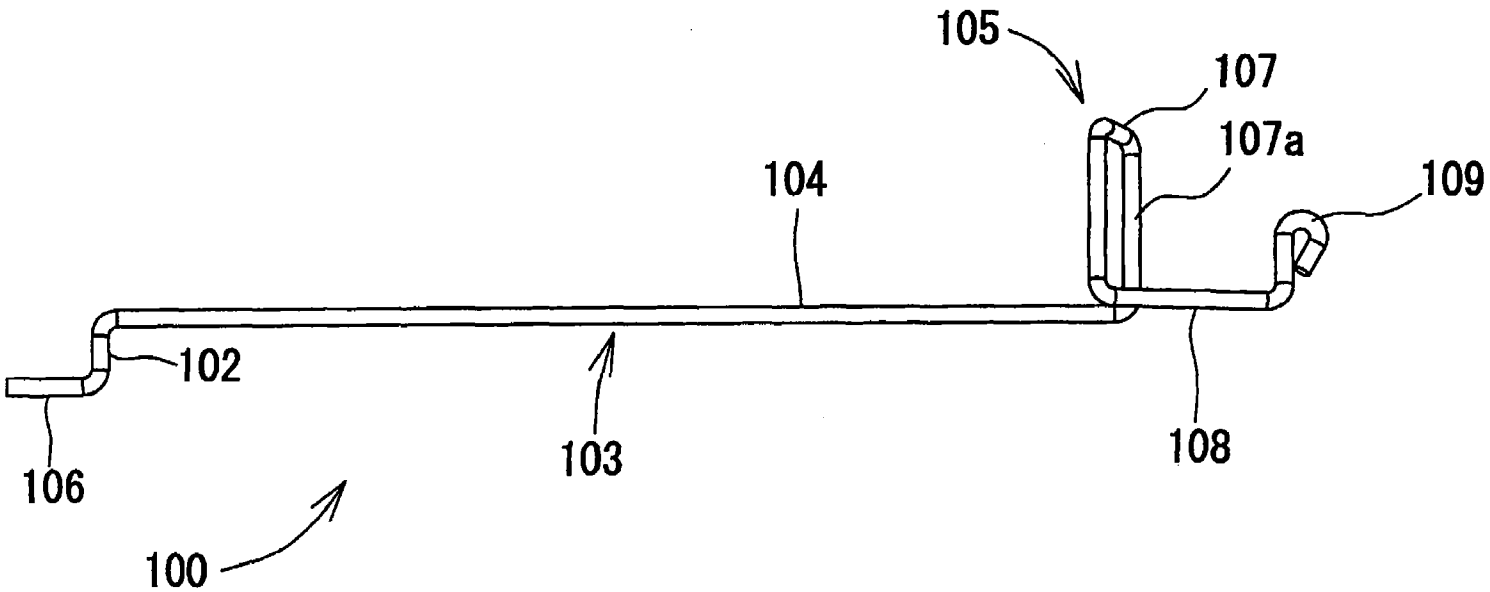
FIG. 5 is a front view showing the configuration of a rotating support member.
Figure 6:
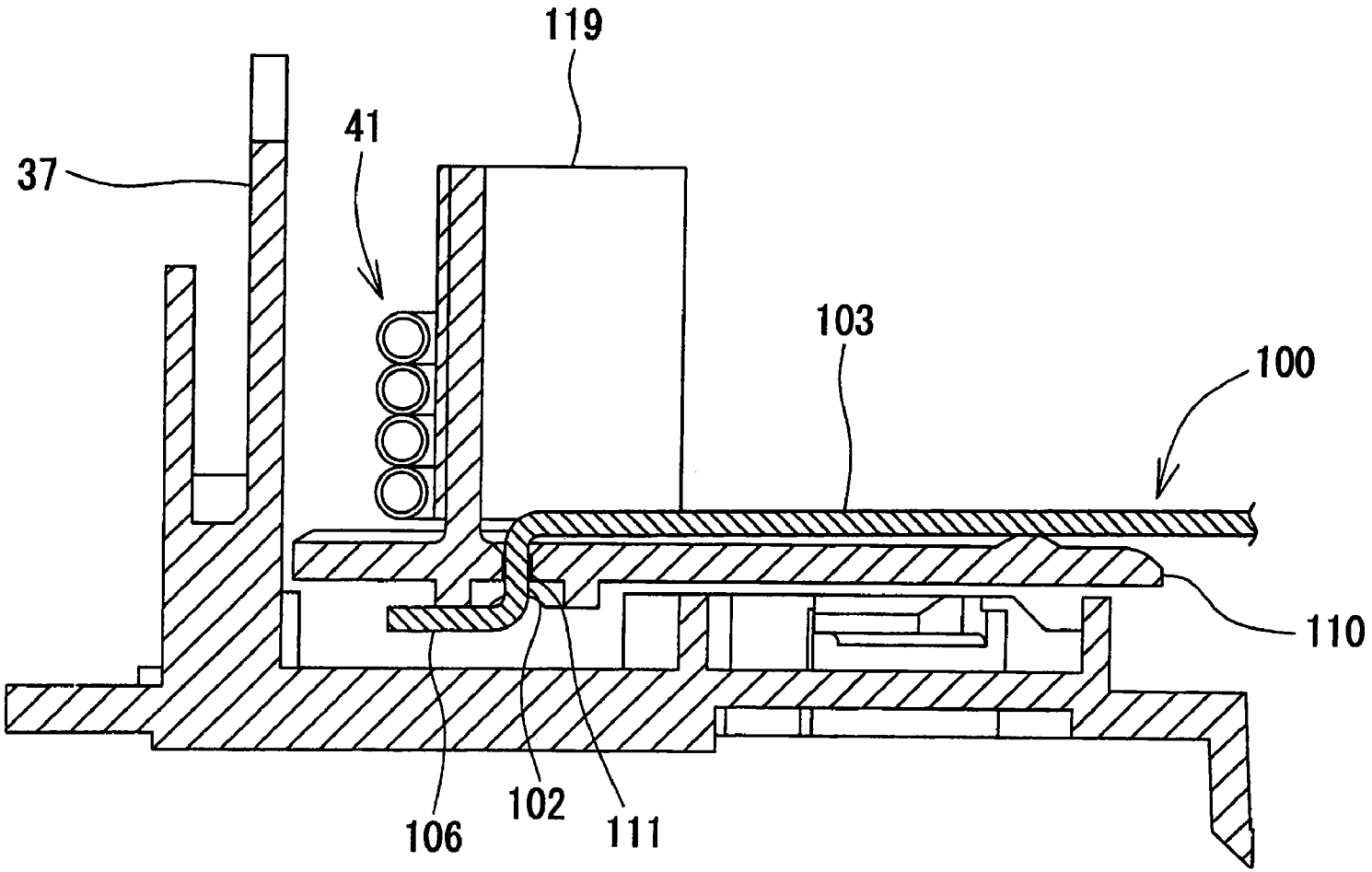
FIG. 6 is a sectional view taken along the line IX-IX in FIG. 14.

FIG. 5 is a front view showing the configuration of the rotating support member 100. FIG. 6 is a sectional view of the same taken along the line IX-IX in FIG. 14 as will be described later.

As shown in FIG. 5, the rotating support member 100 has a shaft portion 102 having an axis directed in the vertical direction, which functions as a rotation axis, an arm 103 extended in the lateral direction from the shaft portion 102, a carrying portion 104 formed at a base end side of the arm 103, a holding portion 105 formed on a tip end side of the arm 103, an auxiliary arm 106 extended from a lower end portion of the shaft portion 102 in a direction opposite to the arm 103 laterally so as to be formed into a crank shape with respect to the shaft portion 102 and the arm 103, and each of the above-described constituent members are integrally formed by bending a steel wire.

The shaft portion 102 and the arm 103 are bent at approximately right angle, and as shown in FIG. 6, the shaft portion 102 is inserted into a shaft hole 111 bored on a support substrate 110 which is fixed to the apparatus body. Thus, the shaft portion 102 is pivotally supported to the support substrate 110, with its axis directed in the vertical direction. The arm 103 is extended in the lateral direction approximately in parallel to the surface of the support substrate 110. The shaft portion 102 can slidably move against the shaft hole 111. When the apparatus body is set on the horizontal plane, with the shaft portion 102 as a rotation axis, the arm 103 rotates along substantially the horizontal plane. Accordingly, explanation will be given hereunder, on the assumption that the apparatus body is set on the horizontal plane. Note that as shown in FIG. 4, the support substrate 110 is fixed to the apparatus body between a regulating member 37 as will be described later and the guide rail 44.

The upper surface of the arm 103 extended in the horizontal direction functions as the carrying portion 104 for carrying the flat cable 85. The carrying portion 104 is brought into contact with a lower end portion of the flat cable 85 with its front and rear surfaces extending in the vertical direction. The lower end portion of the flat cable 85 freely slides on the carrying portion 104 when changing the posture by following the reciprocating motion of the carriage 38. Therefore, in a reciprocating range of the carriage 38, a length of the arm 103 forming the carrying portion 104 is set, so that the carrying portion 104 can slidably carry the flat cable 85.

The holding portion 105 formed on the tip end side of the arm 103 is provided for holding the ink tubes 41. The holding portion 105 is composed of an annular portion 107 formed into a longitudinally rectangular shape in the vertical direction, a tip end arm 108 extended toward the tip end from the annular portion 107, and a curved portion 109 formed on the tip end of the tip end arm 108. A lateral width of internal dimension of the rectangular shape which is formed by the annular portion 107 is approximately equal to an outer diameter of the ink tube 41, and a height of the internal dimension of the rectangular shape is four times the outer diameter of the ink tube 41, namely, is approximately equal to the height of sum total of the four ink tubes 41 arranged in the vertical direction. By defining the internal dimension of the rectangular shape of the annular portion 107 in such a way, it is possible to prevent the arrangement order of the four ink tubes from interchanging with each other in the annular portion 107. The annular portion 107 is formed by being bent so that a steel wire material forming the rotating support member 100 can stand upright from the arm 103, and further by being bent in the lateral direction and downward so as to be formed into the longitudinally rectangular shape in the vertical direction. The tip end arm 108 of the annular portion 107 is extended in the same direction as an extending direction of the arm 103. In the tip end of the tip end arm 108, the curved portion 109 is formed by being curved in an arc shape toward outside the extending direction of the arm 103 after being bent upward.

By carrying the four ink tubes 41 by the tip end arm 108, in a state of being passed through the annular portion 107 of the holding portion 105, predetermined portions of the ink tubes 41 are slidably held by the holding portion 105. The annular portion 107 holds the four ink tubes 41 in a state of maintaining the arrangement in the vertical direction fixed by the fixing clip 36. Thus, when the four ink tubes 41 change the posture by following the reciprocating motion of the carriage 38, they will not move randomly, but posture thereof can be integrally changed while the arrangement in the vertical direction is maintained at the predetermined portion. The ink tubes 41 can be slidable to both sides in the extending direction in a state of being passed through the annular portion 107. Accordingly, when a posture change of the ink tubes 41 occurs, the ink tubes 41 slide to some extent in a state of being passed through the annular portion 107. Therefore, an excessive load is not applied to the ink tubes 41. Meanwhile, by a friction between the ink tubes 41 and the annular portion 107, the posture change of the ink tubes 41 are transmitted as a rotating force of the rotating support member 100.

The four ink tubes 41 passed through the annular portion 107 are carried by the tip end arm 108 located on the tip end side more than the annular portion 107. Accordingly, along with the posture change by following the reciprocating motion of the carriage 38, the four ink tubes 41 slide on the tip end arm 108 located on the tip end side more than the annular portion 107. Namely, the ink tubes 41 are freely slidable between the annular portion 107 and the curved portion 109 of the tip end arm 108. The tip end side of the tip end arm 108 is bent upward to thereby form the curved portion 109. Therefore, the ink tube 41 is prevented from dropping from the tip end arm 108. In addition, the curved portion 109 is bent in an arc shape toward outside the extending direction of the arm 103. Therefore, the tip end and a sharp-pointed portion of the steel wire material are prevented from coming into contact with the ink tube 41. Thus, damage to the ink tubes 41 is prevented.

As shown in FIG. 6, the upper surface of the auxiliary arm 106 comes into contact with a portion around the shaft hole 111 on the lower surface of the support substrate 110. Thus, the shaft portion 102 is prevented from being pulled out of the shaft hole 111, and the holding portion 105 on the tip end side of the arm 103 is prevented from hanging downward. Note that on the upper and lower surfaces around the shaft hole 111 of the support substrate 110, a support rib for supporting the arm 103 and the auxiliary arm 106 respectively may be formed.

By the rotating support member 100 thus constructed, the ink tubes 41 and the flat cable 85 both changing the posture by following the reciprocating motion of the carriage 38 are supported at predetermined heights. As described above, the ink tubes 41 are held by the holding portion 105, and the flat cable 85 is carried by the carrying portion 104. When the ink tubes 41 change their posture by following the reciprocating motion of the carriage 38, since the posture change of the ink tubes 41 is transmitted to the arm 103 through the holding portion 105, the arm 103 rotates about the shaft portion 102 as a rotation axis.

As shown in FIG. 4 and FIG. 6, on the front side of the apparatus of the ink tubes 41 and the flat cable 85, the regulating member 37 is arranged extending in the width direction of the apparatus (right-left direction in FIG. 4). The regulating member 37 is a wall-like member having a wall surface in the vertical direction (in the vertical direction with respect to the horizontal plane when the apparatus body is set on the horizontal plane) which comes into contact with the ink tubes 41 and is linearly erected along the reciprocating direction of the carriage 38. The regulating member 37 is arranged along the extending direction of the ink tubes 41 from the position of the fixing clip 36 for fixing the ink tubes 41, and has a height high enough for all of the four ink tubes 41 arranged in the vertical direction by the fixing clip 36 to be brought into contact therewith.

The ink tubes 41 are extended along the regulating member 37 from the fixing clip 36, and by making contact with the wall surface inside the regulating member 37, they are restricted from swelling toward the front surface of the apparatus, in other words, in a direction remote from the carriage 38. In a state where the ink tubes 41 come into contact with the regulating member 37 (see FIG. 15), the arrangement of the ink tubes 41 from the fixing clip 36 to the curved portion of the ink tubes 41 is maintained in the arrangement in the vertical direction in the fixing clip 36. Therefore, in the curved portion having approximately U-shape, the ink tubes 41 can be surely maintained in a state of being arranged in a desired oblique direction.

The fixing clip 36 is provided in the vicinity of nearly the center of the apparatus in the width direction, and the ink tubes 41 are fixed so as to extend toward the regulating member 37. Namely, an obtuse angle smaller than 180° in plan view is formed by the vertical wall surface of the regulating member 37 and the direction in which the ink tubes 41 are extended by the fixing clip 36. Although the ink tubes 41 have flexibility, they have also a suitable extent of elasticity (bending rigidity). Therefore, by being extended by the fixing clip 36 at a suitable angle with respect to the regulating member 37, the ink tubes 41 are pressed against the wall surface of the regulating member 37. Thus, in the reciprocating range of the carriage 38, the range in which the ink tubes 41 are pressed against along the regulating member 37 is increased, and it is possible to decrease the range, from the curved portion to the portion connected to the carriage 38 of the ink tubes 41, swelling toward the backside of the apparatus, in other words, toward the carriage 38.

The fixing clip 86 is provided in the vicinity of the center of the apparatus in the width direction (right-left direction) and on the backside of the apparatus more than the fixing clip 36, and fixes the flat cable 85 so as to extend toward the regulating member 37. Namely, the vertical wall surface of the regulating member 37 and the direction extending the flat cable 85 by the fixing clip 86 forms the obtuse angle smaller than 180° in plan view. Although the flat cable 85 has the flexibility, it also has a suitable extent of elasticity (bending rigidity). Therefore, by being extended by the fixing clip 86 at a suitable angle with respect to the regulating member 37, the flat cable 85 is pressed against the wall surface of the regulating member 37. Thus, in the reciprocating range of the carriage 38, the range in which the flat cable 85 is pressed along the regulating member 37 is increased, and it is possible to decrease the range, from the curved portion to the portion connected to the carriage 38 of the flat cable 85, swelling toward the backside of the apparatus, in other words, toward the carriage 38.

As shown in FIG. 4 and FIG. 6, a guide plate 119 is arranged standing upright in the vicinity of the shaft hole 111 of the support substrate 110, at a position apart toward the carriage 38 from the regulating member 37. The guide plate 119 is formed only in a predetermined range on a side of the regulating member 37 around the shaft hole 111, and mainly functions when the carriage 38 moves to a side (right side in FIG. 4) where a diameter of a U-shaped curved portion of the flat cable 85 becomes larger (see FIG. 4). The ink tube 41 and the flat cable 85 are inserted between the guide plate 119 and the regulating member 37. Accordingly, when the ink tube 41 and the flat cable 85 come into contact with the wall surface of the guide plate 119, the ink tube 41 and the flat cable 85 are prevented from bending toward the carriage 38 from the fixing clip 36 or the fixing clip 86.

Figure 7:
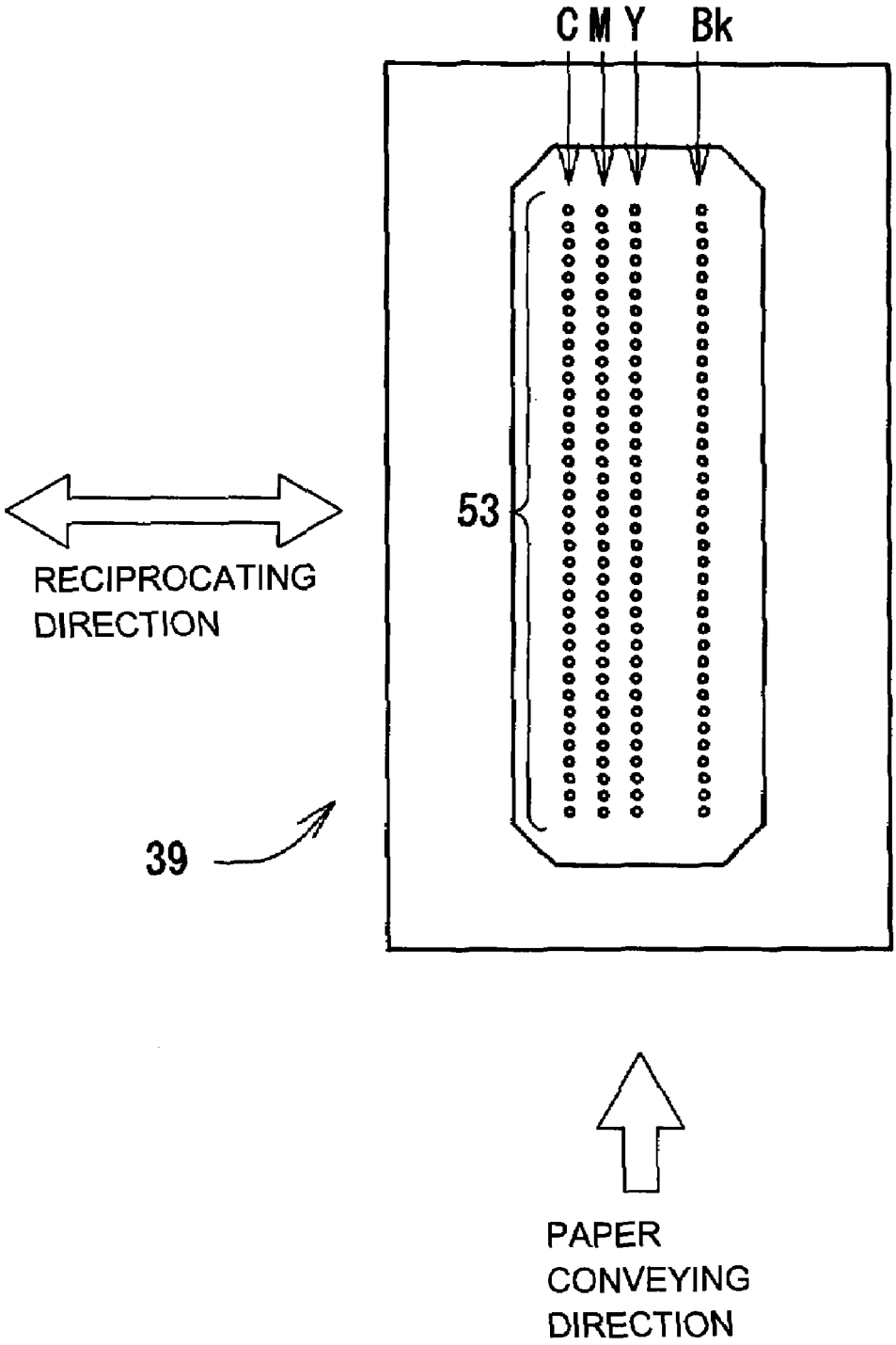
FIG. 7 is a bottom view showing a nozzle forming surface of an ink jet recording head.

FIG. 7 is a bottom view showing a nozzle forming surface of the ink jet recording head 39. As shown in the figure, on the lower surface of the ink jet recording head 39, nozzles 53 are disposed in a row in the paper conveying direction, for each color ink of cyan (C), magenta (M), yellow (Y), and black (Bk). Note that in FIG. 7, the vertical direction is the paper conveying direction, and the right-left direction is the reciprocating direction of the carriage 38. The nozzles 53 of each color ink of CMYBk have nozzles of the same color arranged in the paper conveying direction, respectively, and the arrangement of the nozzles 53 of each color ink line up in the reciprocating direction of the carriage 38. The pitch and the number of each nozzle 53 in the paper conveying direction may be suitably set in consideration of a resolution and the like of a recording image. Also, the number of rows of the nozzles 53 can be increased/decreased in accordance with the number of the kinds of color ink (the number of colors).

Figure 8:
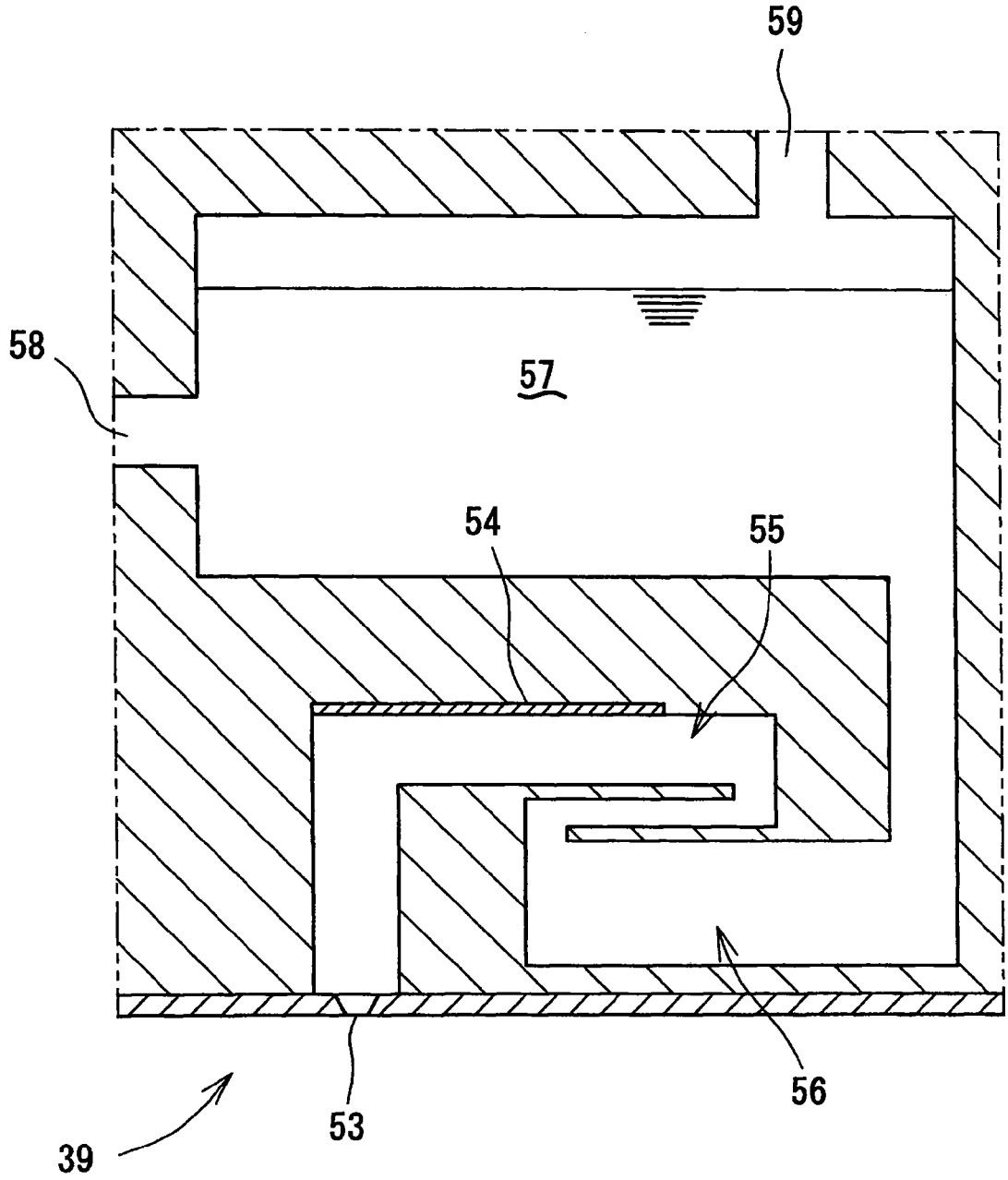
FIG. 8 is an enlarged sectional view showing an internal configuration of the ink jet recording.

FIG. 8 is an enlarged sectional view showing an internal configuration of the ink jet recording head 39. As shown in the figure, a cavity 55 equipped with a piezoelectric element 54 is formed on the upstream side of the nozzles 53 formed on the lower surface of the ink jet recording head 39. The piezoelectric element 54 is deformed when a predetermined voltage is applied thereto, and makes a volume of the cavity 55 be reduced. In accordance with the change of the volume of this cavity 55, the ink in the cavity 55 is ejected from the nozzles 53 as an ink droplet.

A cavity 55 is provided for each nozzle 53, and a manifold 56 common to a plurality of cavities 55 is formed. The manifold 56 is provided for each color ink of CMYBk. A buffer tank 57 is disposed on the upstream side of the manifold 55. The buffer tank 57 is also provided for each color ink of CMYBk. The ink flowing in the ink tube 41 is supplied to each buffer tank 57 from an ink supply port 58. By storing the ink once in the buffer tank 57, the bubble generated in the ink is captured by the ink tube 41 and the like, and invasion of the bubble into the cavity 55 and the manifold 56 is prevented. The bubble captured in the buffer tank 57 is sucked and removed by a pump mechanism from a bubble discharge port 59. The ink supplied from the buffer tank 57 to the manifold 56 is distributed to each cavity 55 by the manifold 56.

In this way, an ink passage is constituted so that each color ink supplied from the ink cartridge through the ink tube 41 flows to the cavity 55 through the buffer tank 57 and the manifold 56. Each color ink of CMYBk thus supplied through the aforementioned ink passage is ejected onto the recording paper from the nozzles 53 as an ink droplet.

As shown in FIG. 3, a pair of a conveying roller 60 and a pinch roller are provided on the upstream side of the image recording unit 24. In FIG. 3, although the pinch roller is concealed by other member and not shown, it is disposed on the lower side of the conveying roller 60 in a state of being brought into pressure-contact therewith. The conveying roller 60 and the pinch roller pinch a paper sheet conveyed on the paper conveying path 23, and convey it on the platen 42. A pair of a paper discharge roller 62 and a spur roller 63 are provided on the downstream side of the image recording unit 24. The paper discharge roller 62 and the spur roller 63 pinch a recorded recording paper and convey it to the paper discharge tray 21. A driving force is transmitted from the LF motor 71, and by this driving force, the conveying roller 60 and the paper discharge roller 62 are intermittently driven at a predetermined line feed width. Rotations of the conveying roller 60 and the paper discharge roller 62 are synchronized. A rotary encoder 76 (see FIG. 9) provided in the conveying roller 60 detects a pattern of an encoder disk 61 rotating together with the conveying roller 60. Based on this detection signal, the rotation of the conveying roller 60 and the paper discharge roller 62 are controlled.

The spur roller 63 are brought into pressure-contact with the recorded recording paper, and therefore a roller surface is formed in a spur-shape so as not to deteriorate the image recorded on the recording paper. The spur roller 63 is slidably provided in a direction of coming into contact with or separating from the paper discharge roller 62, and energized by a coil spring so as to be brought into pressure-contact with the paper discharge roller 62. When the recording paper enters between the paper discharge roller 62 and the spur roller 63, the spur roller 63 retreats opposing an energizing force by an amount of a thickness of the recording paper. Whereby, the recording paper is pinched therebetween so as to be brought into pressure-contact with the paper discharge roller 62. Thus, the rotating force of the discharge roller 62 is surely transmitted to the recording paper. The pinch roller is similarly provided with respect to the conveying roller 60, pinches the recording paper so as to be brought into pressure-contact with the conveying roller 60, and surely transmit the rotating force of the conveying roller 60 to the recording paper.

Figure 9:
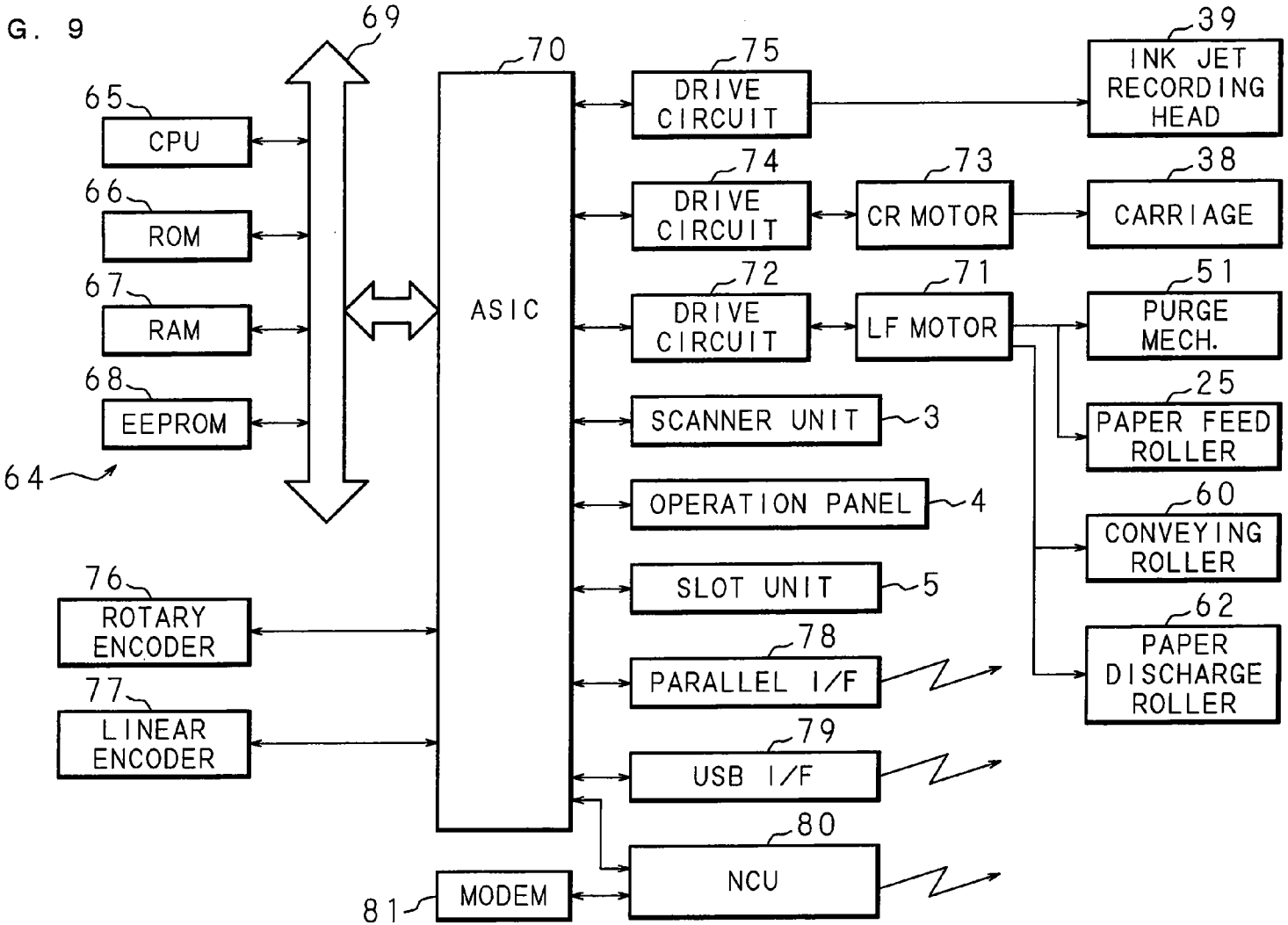
FIG. 9 is a block diagram showing the configuration of a multi-function device control unit according to the embodiment of the image recording apparatus of the present invention.

FIG. 9 is a block diagram showing the configuration of the control unit of the MFD 1 according to the embodiment of the image recording apparatus of the present invention. The control unit 64 controls an entire operation of the MFD 1 including not only the printer unit 2 but also the scanner unit 3. Note that the control unit 64 is composed of a main substrate having the flat cable 85 connected thereto. However, the configuration of the scanner unit 3 is not a main configuration of the present invention, and therefore a detailed explanation is omitted.

As shown in the figure, the control unit 64 is constituted as a micro computer mainly composed of a CPU (Central Processing Unit) 65, a ROM (Read Only Memory) 66, a RAM (Random Access Memory) 67, and an EEPROM (Electrically Erasable and Programmable ROM) 68, and is connected to an ASIC (Application Specific Integrated Circuit) 7 through a buss 69.

The ROM 66 stores a program and the like for controlling each kind of operation of the MFD 1. The RAM 67 is used as a storage area or a working area temporarily storing each kind of data used when the above-described program is executed by the CPU 65. In addition, the EEPROM 68 stores a setting and a flag and the like to be held after turning off a power source.

By following the instruction from the CPU 65, the ASIC 70 generates a phase excitation signal and the like for applying to the LF (conveying) motor 71, and gives it to a drive circuit 72 of the LF motor 71. By following the signal thus given, the drive circuit 72 controls the rotation of the LF motor 71 by applying the drive signal to the LF motor 71.

The drive circuit 72 drives the LF motor 71 connected to the paper feed roller 25, conveying roller 60, paper discharge roller 62, and purge mechanism 51. By receiving an output signal from the ASIC 70, the drive circuit 72 generates an electric signal for rotating the LF motor 71. By receiving the electric signal, the LF motor 71 is rotated, and by the rotation of the LF motor 71, the rotating force of the LF motor 71 is transmitted to the paper feed roller 25, conveying roller 60, paper discharge roller 62, and purge mechanism 51, through a well known drive mechanism composed of gears and drive shafts.

By following the instruction from the CPU 65, the ASIC 70 generates a phase excitation signal and the like to be applied to the CR (carriage) motor 73, and gives it to a drive circuit 74 of the CR motor 73. By following the signal thus given, the drive circuit 74 controls the rotation of the CR motor 73 by applying the drive signal to the CR motor 73.

The drive circuit 74 drives the CR motor 73. By receiving the output signal from the ASIC 70, the drive circuit 74 generates the electric signal for rotating the CR motor 73. By receiving the electric signal, the CR motor 73 is rotated, and by the rotation of the CR motor 73, the rotating force of the CR motor 73 is transmitted to the carriage 38 through the belt drive mechanism 46, thereby reciprocating the carriage 38. In this way, the reciprocating motion of the carriage 38 is controlled by the control unit 64.

A drive circuit 75 makes each color ink selectively eject from the ink jet recording head 39 onto the recording paper at a predetermine timing. Based on a drive control procedure outputted from the CPU 65, the drive circuit 75 receives the output signal generated in the ASIC 70, and controls a drive of the ink jet recording head 39. The drive circuit 75 is mounted on the head control substrate 40, and the signal is transmitted by the flat cable 85 from the main substrate to the head control substrate 40 constituting the control unit 64.

To the ASIC 70, the rotary encoder 76 for detecting a rotational amount of the conveying roller 60 and the linear encoder 77 for detecting the position of the carriage 38 are connected. The carriage 38 moves to one of the end portions of the guide rails 43 and 44 by turning on the MFD 1, and a detected position by the linear encoder 77 is initialized. When the carriage 38 moves on the guide rails 43 and 44 from such an initial position, the optical sensor 35 provided on the carriage 38 detects the pattern of the encoder strip 50, and the number of pulse signals based on this pattern is grasped by the control unit 64 as a reciprocating amount of the carriage 38. The control unit 64 controls the rotation of the CR motor 73 so as to control the reciprocating motion of the carriage 38 based on its moving amount.

To the ASIC 70, the scanner unit 3, the operation panel 4 for performing an operating instruction of the MFD 1, the slot unit 5 into which each kind of small-sized memory card is inserted, a parallel interface (I/F) 78 and a USB interface (I/F) 79 for transmitting and receiving data to and from external information apparatus such as a personal computer through a parallel cable or a USB cable, and so forth are connected. Further, an NCU (Network Control Unit) 80 and a modem (MODEM) 81 for realizing a facsimile function are connected to the ASIC 70.

Figure 10:
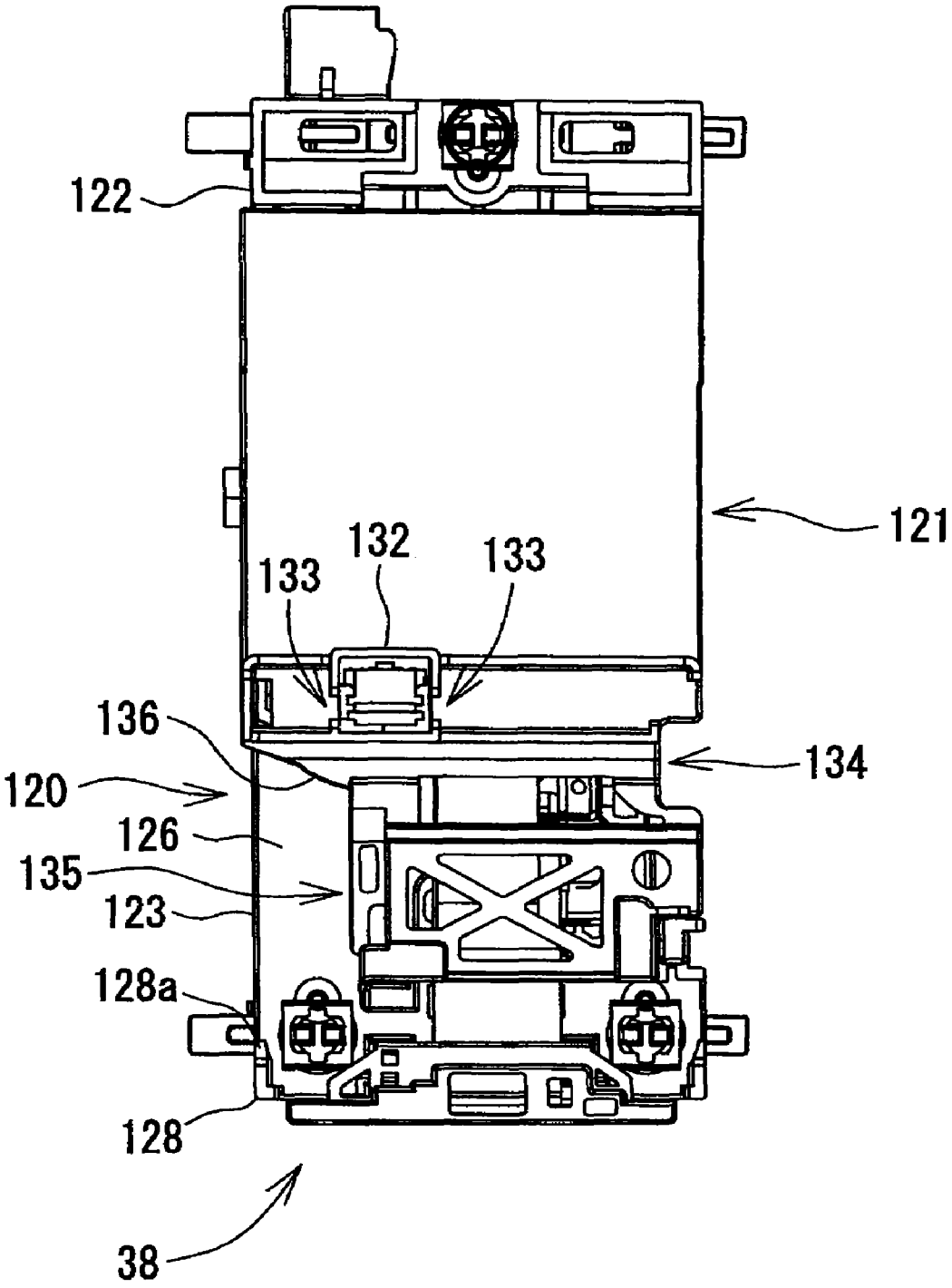
FIG. 10 is a plan view of the carriage of the printer unit according to the embodiment of the image recording apparatus of the present invention.
Figure 11:
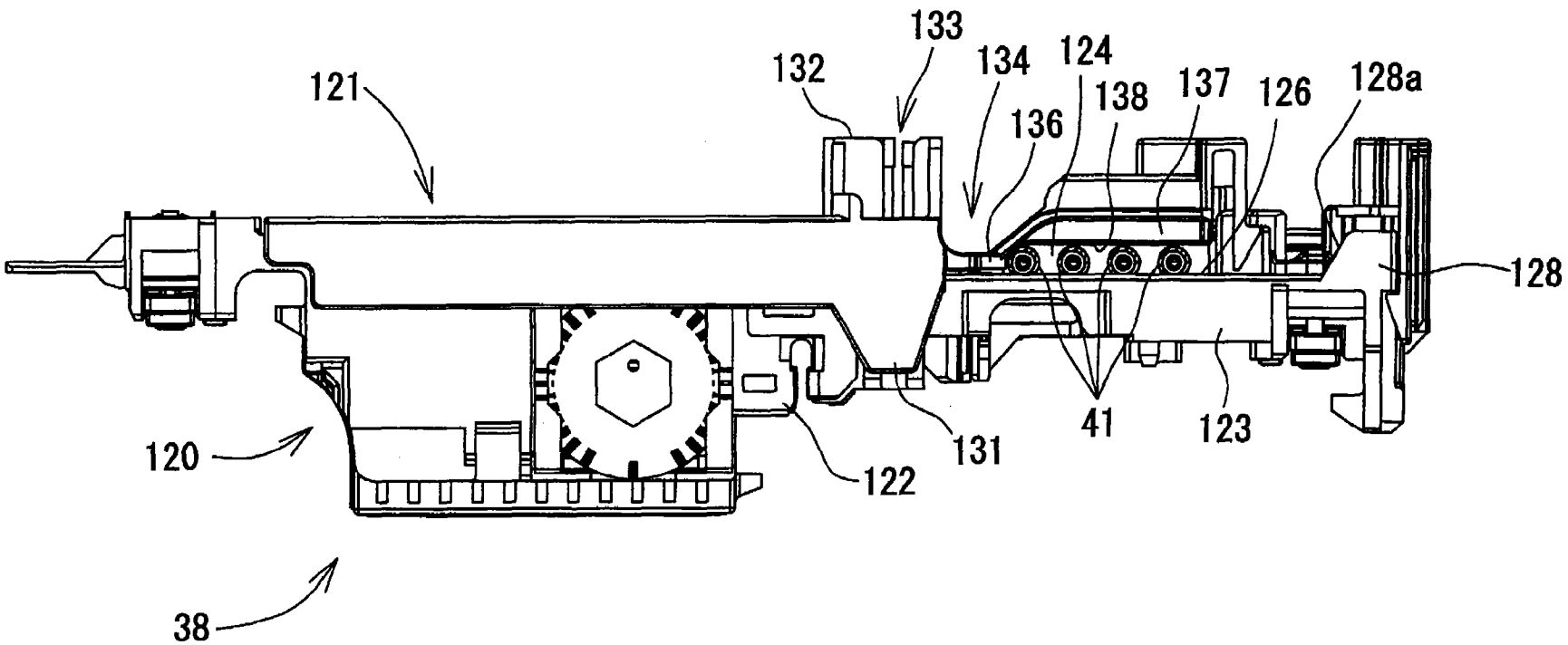
FIG. 11 is a side view of the carriage of the printer unit according to the embodiment of the image recording apparatus of the present invention.
Figure 12:
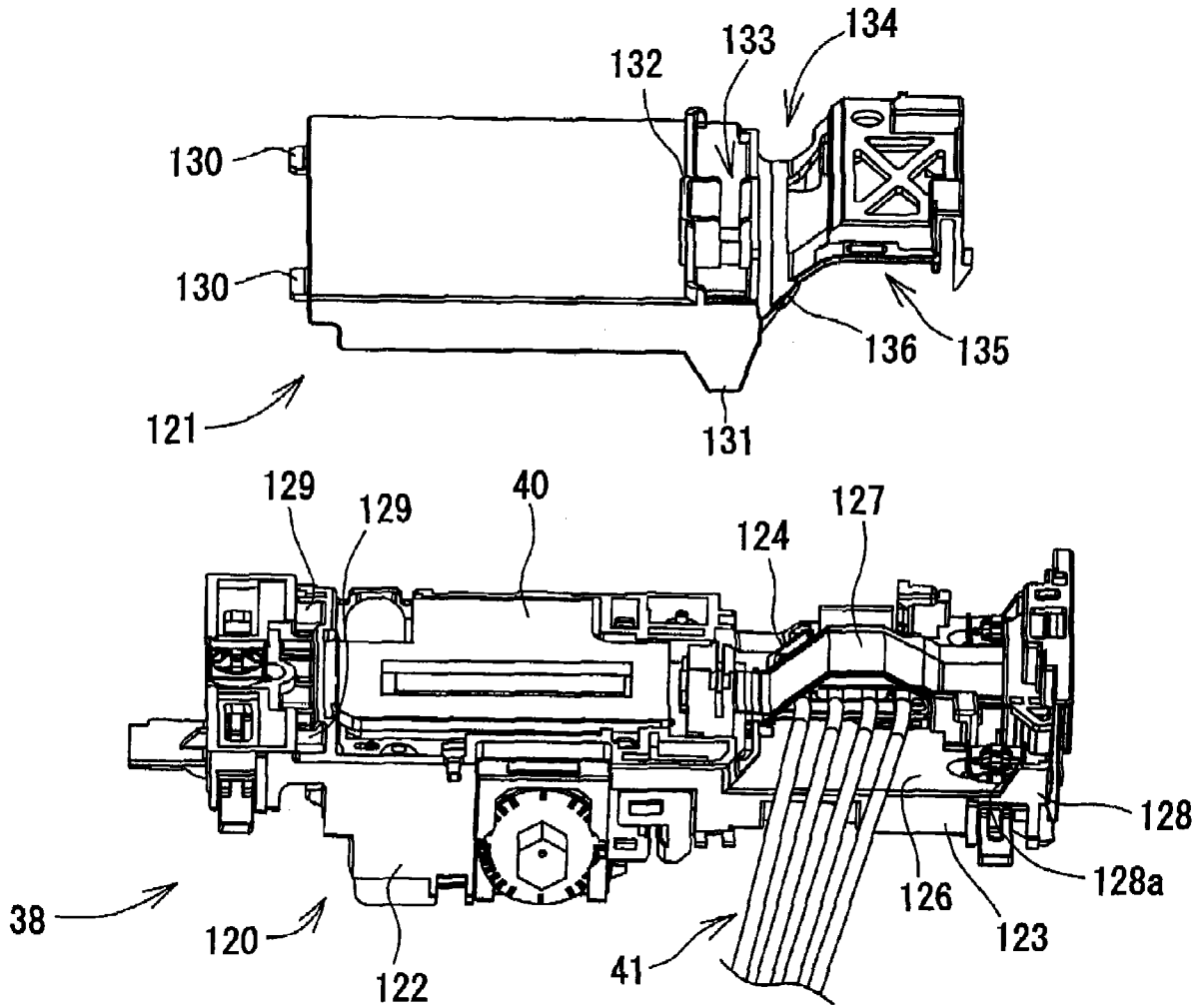
FIG. 12 is an exploded perspective view showing a separated state of a carriage body and a carriage cover of the printer unit according to the embodiment of the image recording apparatus of the present invention.
Figure 13:
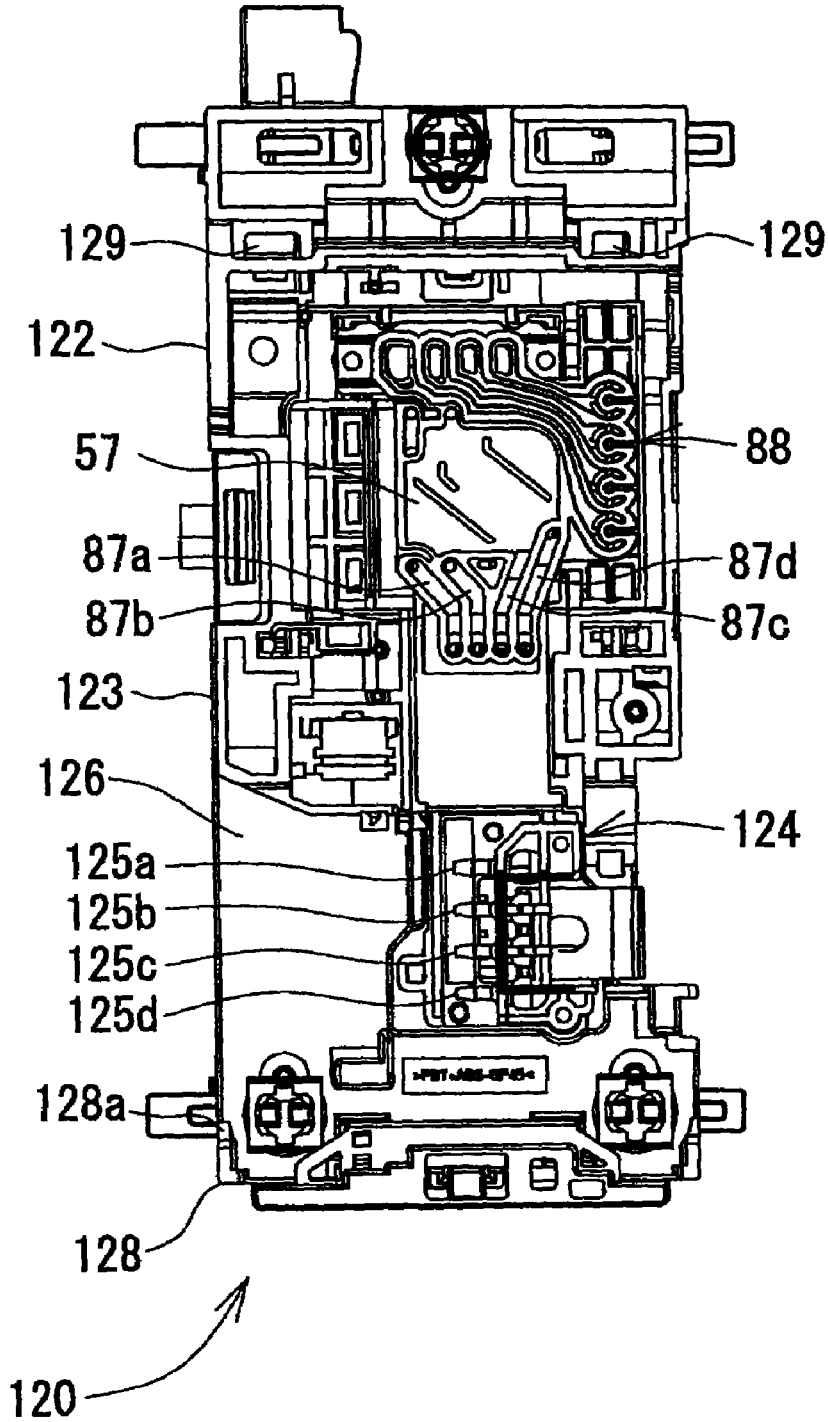
FIG. 13 is a plan view showing the carriage, with the carriage cover and a head control substrate of the printer unit removed, according to the embodiment of the image recording apparatus of the present invention.

The configuration for fixing the ink tubes 41 in the carriage 38 will be described in detail hereunder. FIG. 10 is a plan view of a carriage of a printer unit according to the embodiment of the image recording apparatus of the present invention. FIG. 11 is a side view of the carriage of the printer unit according to the embodiment of the image recording apparatus of the present invention. FIG. 12 is an exploded perspective view showing a separated state of a carriage body and a carriage cover of the printer unit according to the embodiment of the image recording apparatus of the present invention. FIG. 13 is a plan view showing the carriage, with the carriage cover and the head control substrate of the printer unit removed, according to the embodiment of the image recording apparatus of the present invention. Note that in FIG. 10 and FIG. 12, the ink tubes 41 are not shown.

The carriage 38 has a carriage body 120 for holding the ink jet recording head 39 and the carriage cover 121 covering the upper side of the carriage body 120. In the carriage body 120, a box-shaped holding portion 122 for holding the ink jet recording head 39 and an arm portion 123 extended from the holding portion 122 to the downstream side (lower side in FIG. 10 and FIG. 13, and right side in FIG. 11 and FIG. 12) in the paper conveying direction are formed.

The holding portion 122 is formed in a box-shape whose upper surface is opened, and the ink jet recording head 39 is held in its internal space. A part of the lower surface of the holding portion 122 is opened in accordance with region of the nozzles 53 of the ink jet recording head 39. The ink jet recording head 39 ejects the ink from the nozzles 53 through such openings. Note that the lower surface side of the holding portion 122 is not shown.

As shown in FIG. 13, a part of the buffer tank 57 of the ink jet recording head 39 is exposed on the upper surface side of the holding portion 122. As described above, although the buffer tank 57 is provided for each ink color, in the figure, partitions for each ink color are not shown. Four ink passages 87*a*, 87*b*, 87*c*, 87*d* are formed for each ink color on the downstream side more than the buffer tank 57 in the paper conveying direction. Each of the ink passages 87*a*, 87*b*, 87*c*, and 87*d* connects the ink supply port 58 (see FIG. 8) of the buffer tank 57 provided for each ink color and a joint portion 124, so that the ink can flow therethrough. In addition, contiguously to the buffer tank 57, an exhaust passage 88 is formed for each ink color. The exhaust passage 88 is connected to the bubble discharge port 59 of each buffer tank 57, and serves as a passage for discharging air accumulated in the buffer tank 57 to outside. An exhaust valve 89 (see FIG. 4) provided in the purge mechanism 51 is connected to the exhaust passage 88. In this state, when the pump mechanism of the purge mechanism 51 is operated, the air accumulated in the buffer tank 57 is sucked and removed to the outside through the exhaust passage 88.

The joint portion 124 is disposed on the upper surface of the arm portion 123 of the carriage body 120. The joint portion 124 has connectors 125*a*, 125*b*, 125*c*, and 125*d* to which the end portions of the ink tubes 41 are connected, respectively. The connectors 125*a*, 125*b*, 125*c*, and 125*d* are integrally formed with the joint portion 124, and are arranged in the lateral direction along the paper conveying direction. Note that the tip end of each of the connectors 125*a*, 125*b*, 125*c*, and 125*d* is directed to one direction along the reciprocating direction of the carriage 38. Each of the connectors 125*a*, 125*b*, 125*c*, and 125*d* has substantially a tubular shape, and its tip end is formed in a tapered shape wherein the diameter is reduced toward the tip end. By inserting the end portion of the ink tube 41 into the tip end portion having the tapered shape, the ink tube 41 is connected to the joint portion 124. Thus, the four ink tubes 41 are connected to the joint portion 124 in a state of being aligned in the lateral direction.

The tip end of each of the connectors 125*a*, 125*b*, 125*c*, and 125*d* of the joint portion 124 is opened, and a tubular internal space is communicated with each opening formed on the bottom surface of the joint portion 124. Note that in the figure, the bottom surface of the joint portion 124 is not shown. Each opening of the bottom surface of the joint portion 124 is respectively connected to ink flow passages 87*a*, 87*b*, 87*c*, and 87*d* in watertight condition through a sealing member such as a joint rubber. Thus, a flow passage of each color ink is formed from each connector 125*a*, 125*b*, 125*c*, and 125*d* to each buffer tank 57 through each ink flow passage 87*a*, 87*b*, 87*c*, and 87*d*, and each color ink supplied through each ink tube 41 is flown in to each buffer tank 57.

As shown in FIG. 12 and FIG. 13, the joint portion 124 is disposed on one side in the direction of the reciprocating direction of the carriage 38 on the upper surface of the arm portion 123 of the carriage body 120, and the connectors 125*a*, 125*b*, 125*c*, and 125*d* protrude horizontally toward the other side. The joint portion 124 occupies a region having a width in the reciprocating direction about half the upper surface of the arm portion 123, and in the remaining half region, in which the connectors 125*a*, 125*b*, 125*c*, and 125*d*, namely, the ink tubes 41 protrude, a flat plane 126 of the upper surface of the arm portion 123 is exposed. Accordingly, as shown in FIG. 12, each ink tube 41 connected to the joint portion 124 is carried on the flat plane 126, and is freely slidable in the lateral direction, specifically in a surface direction of the flat plane 126.

As shown in FIG. 4, the end portion on the upstream side of the carriage 38 in the paper conveying direction is carried on the guide rail 43, and the end portion on the downstream side of the carriage 38 in the paper conveying direction is carried on the guide rail 44. The flat plane 126 is located between carrying portions (sliding surfaces) where the carriage 38 is carried by the guide rails 43 and 44. By carrying the ink tubes 41 by the flat plane 126, the weight of the ink tubes 41 acts on the sliding surfaces of the carriage 38. If the weight of the ink tubes 41 unevenly acts on either of the sliding surfaces on both sides of the carriage 38 in the paper conveying direction, a frictional resistance becomes larger only on the sliding surface of the above mentioned one side, generating a rotation moment during sliding of the carriage 38. As is seen in this embodiment, when the flat plane 126 for supporting the ink tubes 41 is disposed between the both sliding surfaces of the carriage 38, the weight of the ink tubes 41 acts on the portion close to a center of gravity of the carriage 38, thus making it hard to generate the rotation moment during reciprocating of the carriage 38. In addition, the flat plane 126 is integrally formed with the carriage body 120, and since there are sliding surfaces (carrying portions) on both sides of the flat plane 126 in the paper conveying direction, an advantage is that the rigidity of the flat plane 126 becomes high.

As shown in FIG. 10, FIG. 11, FIG. 12, and FIG. 13, in a corner portion crossing an edge of the flat plane 126 in the reciprocating direction of the carriage 38 and an edge on the downstream side in the paper conveying direction, a regulating wall 128 rising from the flat plane 126 is formed. The regulating wall 128 has a height from the flat plane 126 larger than an outer diameter of one ink tube 41, and a wall surface 128*a* directed toward the upstream side in the paper conveying direction is formed into a surface inclined toward the downstream side in the paper conveying direction. The wall surface 128*a* is apart from a predetermined distance from a ink tube 41 connected to the joint portion 124 on the most downstream side in the paper conveying direction. Accordingly, the most downstream ink tube 41 is slidable on the flat plane 126 in the horizontal direction to the downstream side along the paper conveying direction until coming into contact with the wall surface 128*a*. In other words, the wall surface 128*a* of the regulating wall 128 restricts a slidable range of the most downstream ink tube 41 to the downstream side in the paper conveying direction. The position of the wall surface 128*a* is selected to be the position where the most downstream ink tube 41 is not in contact with other members provided in the carriage body 120 when it is brought into contact with the wall surface 128*a*.

As shown in FIG. 12, a protective cover 127 for protecting a connection portion of the ink tubes 41 and the joint portion 124 is attached on the upper side of the joint portion 124. The protective cover 127 is formed in approximately an arched shape extending toward the paper conveying direction, and is attached so as not to make contact with each ink tube 41. Also, the head control substrate 40 is disposed above the buffer tank 57 and the like. Then, as shown in FIG. 10, the carriage cover 121 is attached so as to cover the head control substrate 40, joint portion 124, and a part of the flat plane 126.

As shown in FIG. 12, engaging pieces 130 are formed in the carriage cover 121 on the upstream side in the paper conveying direction. In addition, an engaging claw 131 is protruded downward in the vicinity of the center of the carriage cover 121 in the paper conveying direction. In the carriage body 120, engaging holes 129 are formed corresponding to the engaging pieces 130. By engaging the engaging pieces 130 into the engaging holes 129, the downstream side of the carriage cover 121 in the paper conveying direction is fixed to the carriage body 120. Meanwhile, the engaging claw 131 is extended up to the bottom surface of the carriage body 120, and although not shown, a claw engaging with the bottom surface of the carriage 120 is formed in the inside. In addition, the same engaging claw as the engaging claw 130 shown in FIG. 11 and FIG. 12 is also formed on the opposite side of the carriage cover 121 in the reciprocating direction. When the carriage cover 121 is fixed to the carriage body 120, the engaging claw 130 is elastically deformed so as to be expanded to the outside, and when the claw reaches the bottom surface of the carriage body 120, the engaging claw 130 elastically restores inside, thereby making it possible to engage with the bottom surface of the carriage body 120. In this way, the carriage cover 121 is fixed on the upper side of the carriage body 120.

On the upper surface of the carriage cover 121, an opening is formed at a position corresponding to the head control substrate 40. A protective wall 132 stands upright along the edge portion of the opening. Note that the opening is provided for exposing the optical sensor 35 (see FIG. 4) disposed on the head control substrate 40, and the protective wall 132 surrounds sides of the optical sensor 35. In the protective wall 132, slits 133 are formed in the vertical direction. The encoder strip 50 of the linear encoder 77 is inserted into the slits 133.

In the carriage cover 121, a curved portion 134 curving downward along the reciprocating direction of the carriage 38 is formed on the downstream side of the protective wall 132 in the paper conveying direction. As shown in FIG. 11, the curved portion 134 curves downward into a position closer to the flat plane 126 of the carriage body 120. The curved portion 134 is located on an immediately upstream side of the ink tube 41 on the most upstream side in the paper conveying direction under a condition where the carriage cover 121 is attached to the carriage body 120. When the most upstream ink tube 41 is brought into contact with the curved portion 134, the slidable range of the most upstream ink tube 41 is restricted to the upstream side in the paper conveying direction. The position of the curved portion 134 is made to be the position where the first ink tube 41 is not brought into contact with other members provided in the carriage body 120, when it makes contact with the curved portion 134. The curved portion 134 functions as a regulating wall according to the present invention.

On the downstream side of the carriage cover 121 more than the curved portion 134 in the paper conveying direction, a notch portion 135 recessed in the reciprocating direction of the carriage 38 is formed. The notch portion 135 is recessed into the front of the joint portion 124 in the reciprocating direction of the carriage 38. An edge portion 136 on the upstream side in the paper conveying direction in the vicinity of a bottom of the notch portion 135 is formed in a tapered shape so as to expand in an extending direction of the ink tube 41. When the ink tube 41 on the most upstream side in the paper conveying direction is brought into contact with the edge portion 136, the most upstream ink tube 41 is prevented from making contact with other members and corner portions of the carriage body 120.

As shown in FIG. 11, on the downstream side of the curved portion 134 of the carriage cover 121 in the paper conveying direction, a pressing member 137 making contact with each ink tube 41 extended from the joint portion 124 protrudes downward from the lower surface of the carriage cover 121. A lower end surface 138 of the pressing member 137 is a flat surface parallel to the flat plane 126, and the four ink tubes 41 are pinched by the flat plane 126 and the lower end surface 138 slidably in the lateral direction. In this way, by attaching the carriage cover 121 to the carriage body 120, the arrangement of the ink tubes 41 in the lateral direction is maintained.

An operation of the ink tube 41 and the like in an image recording operation of the printer unit 2 will be explained hereunder. By transmitting the driving force of the CR motor 73 through the belt drive mechanism 46, the carriage 38 on which the recording head 39 is carried is guided by the guide rails 43 and 44 and reciprocates in the direction crossing the paper conveying direction (substantially orthogonal direction to the paper conveying direction). Based on the signal transmitted from the control unit 64 through the flat cable 85, the recording head 39 ejects ink droplets of each color ink supplied through the ink tubes 41 onto the recording paper on the platen 42 at a predetermined timing. A desired image is recorded on the recording paper by alternately repeating an intermittent conveying of the recording paper by the paper feed roller 60 and the paper discharge roller 62, and the reciprocating motion of the carriage 38.

Figure 14:
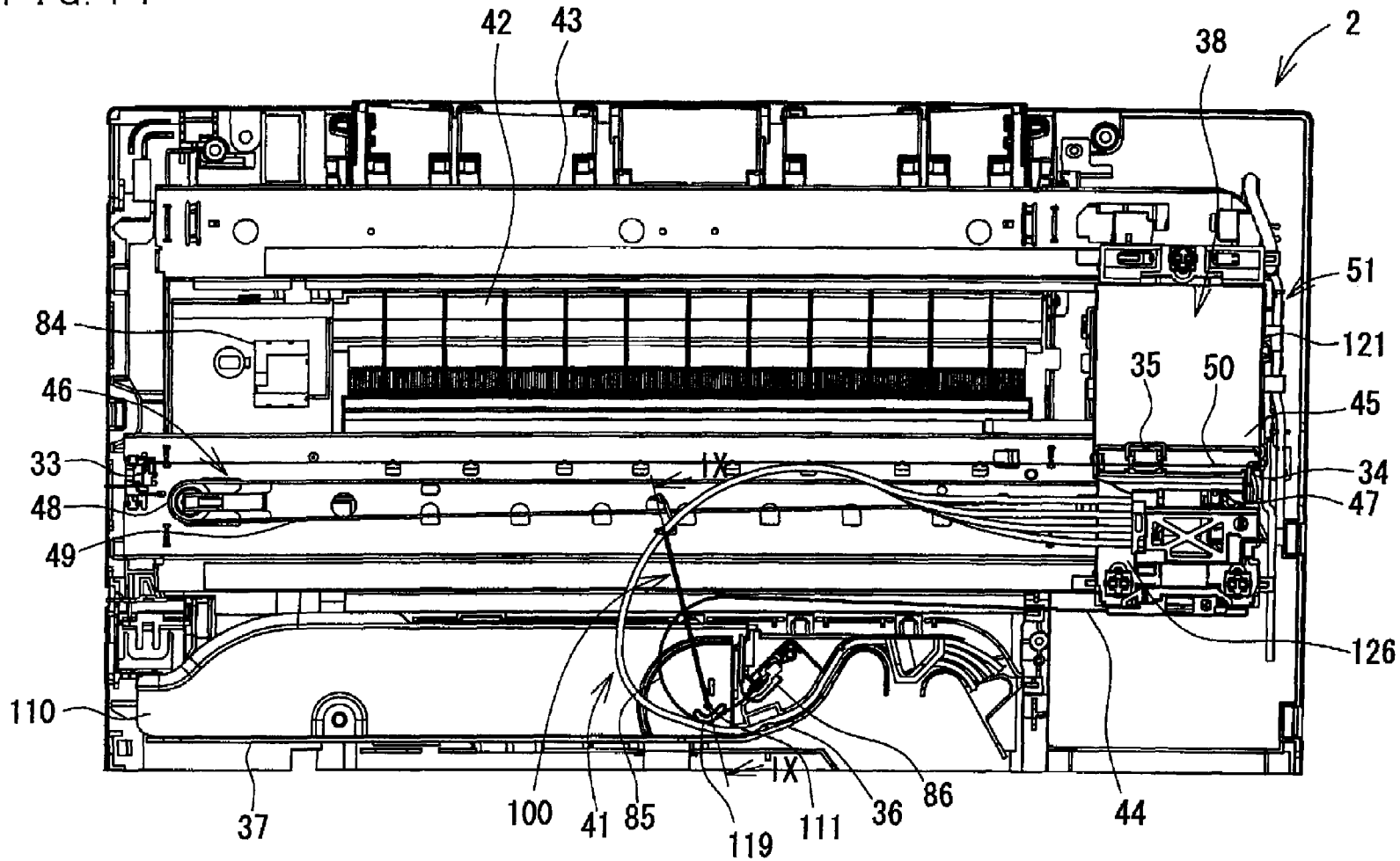
FIG. 14 is a plan view showing the configuration of the essential portion of the printer unit when ink tubes are in one posture.
Figure 15:
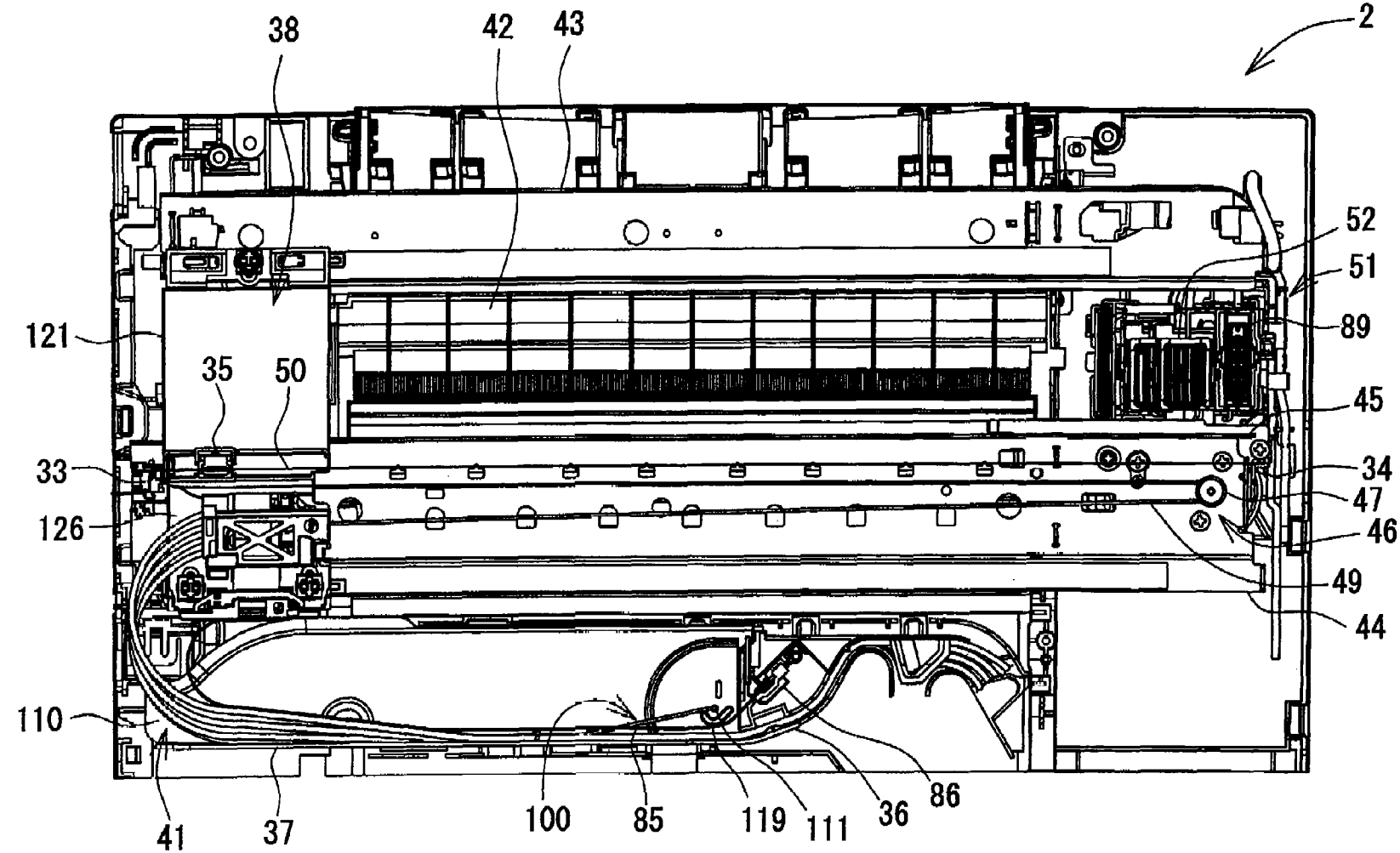
FIG. 15 is a plan view showing the configuration of the essential portion of the printer unit when the ink tubes are in another posture different from that of FIG. 14.

The ink tubes 41 and the flat cable 85, whose one end portions are connected to the carriage 38, respectively, change the posture while changing a curvature of the U-shaped curved portion by following the reciprocating motion of the carriage 38. FIG. 14 shows a state in which the carriage 38 is located at a capping position (right side in the figure) on a cap 52, and FIG. 15 shows a state in which the carriage 38 is located at a flushing position (left side in the figure) on the waste ink tray 84.

As shown in FIG. 14, when the carriage 38 is located at the capping position, the ink tubes 41 and the flat cable 85 become a curved U-shape immediately reversing at a position where they are respectively extended from the fixing clips 36 and 86 toward the flushing position in the reciprocating direction of the carriage 38. Although the ink tubes 41 and the flat cable 85 have flexibility, they have also a certain extent of bending rigidity. Accordingly, by such a bending rigidity, although the U-shaped curved portions of the ink tubes 41 and the flat cable 85 have a tendency of largely swelling onto the guide rail 44, they are brought into contact with the wall surface of the guide plate 119, thus preventing them from bending at a sharp angle toward the carriage 38 from the fixing clips 36 and 86, and the centers of the U-shaped curved portions are shifted to the regulating member 37 side. As a result, since the curved portions of the ink tubes 41 and the flat cable 85 are prevented from expanding, a space for laying out them becomes smaller and a small-sized apparatus can be realized. In addition, lengths of the ink tubes 41 and the flat cable 85 from the fixing clips 36 and 86 to the carriage 38 can be made shorter.

In the vicinity of the capping position, the diameter of the U-shaped curved portion of the four ink tubes 41 becomes largest. Therefore, each ink tube 41 supported by the flat plane 126 of the carriage body 120 has a tendency of sliding on the flat plane 126 from the joint portion 124 to the upstream side in the paper conveying direction. However, as shown in FIG. 11, by the curved portion 134 of the carriage cover 121, the sliding range of each ink tube 41 is restricted to the upstream side in the paper conveying direction. Therefore, the ink tubes 41 extended from the joint portion 124 maintain without flexing a posture of being extended toward the upstream side in the paper conveying direction nearly in parallel to the reciprocating direction of the carriage 38.

As shown in FIG. 4, by sliding and moving the carriage 38 from the capping position to the flushing position, the ink tubes 41 and the flat cable 85 follow the reciprocating motion of the carriage 38 while changing the posture so as to decrease diameters of the U-shaped curved portions. Then, as shown in FIG. 15, when the carriage 38 reaches the flushing position, the diameters of the U-shaped curved portions of the ink tubes 41 and the flat cable 85 become smallest. The ink tubes 41 and the flat cable 85 are fixed by the fixing clips 36 and 86 so as to be pressed against the wall surface of the regulating member 37. Therefore, in the reciprocating range of the carriage 38, the ink tubes 41 and the flat cable 85 are pressed along the regulating member 37. Accordingly, the portion extending along the wall surface of the regulating member 37 of the ink tubes 41 and the flat cable 85 is prevented from separating from the regulating member 37. Thus, the range that the ink tubes 41 and the flat cable 85 swell toward the carriage 38 becomes small, and since the swelling in a direction remote from the carriage 38 is regulated by the regulating member 37, the space for laying out the ink tubes 41 and the flat cable 85 becomes small.

At the flushing position, since the diameter of the U-shaped curved portion of the four ink tubes 41 becomes smallest, each ink tube 41 supported by the flat plane 126 of the carriage body 120 slides on the flat plane 126 toward the paper conveying direction from the joint portion 124. As shown in FIG. 11, the ink tubes 41 are slidable to the downstream side in the paper conveying direction until they are brought into contact with the wall surface 38*a* of the regulating wall 38. Accordingly, the ink tubes 41 extended from the joint portion 124 slide on the flat plane 126, so as to flex toward the downstream side in the paper conveying direction, by following the reciprocating motion of the carriage 38.

In such a way, as shown in FIG. 11, the four ink tubes 41 that change the posture by following the reciprocating motion of the carriage 38 are pinched slidably in the lateral direction between the flat plane 126 of the carriage body 120 and the lower end surface 138 of the pressing member 137 of the carriage cover 121. Therefore, although the posture change of the four ink tubes 41 in the lateral direction is allowed, it is prevented that any one of the ink tubes 41 rides on the other ink tube 41 to thereby disturb the arrangement of the ink tubes 41 in the lateral direction. Accordingly, in the reciprocating range of the carriage 38, the arrangement of the ink tubes 41 in the lateral direction is maintained, and space saving above the carriage 38 is surely realized.

Also, a moving range of the ink tubes 41 in the lateral direction is restricted to a predetermined range by the regulating wall 128 of the carriage body 120 and the curved portion 134 of the carriage cover 121. Accordingly, the ink tubes 41 that slide on the flat plane 126 in the lateral direction by following the reciprocating motion of the carriage 38 are prevented from making contact with a metal member attached to the carriage body 120, corner portions and the like. Thus, breakage of the ink tubes 41 are prevented.

In addition, as shown in FIG. 12, in such a state where the carriage cover 121 is not attached, attaching order of the four ink tubes 41 is not restrained when the ink tubes 41 are connected to the joint portion 124 of the carriage body 120. Therefore, degree of freedom of assembly is improved. Further, at assembling, each ink tube 41 carried on the flat plane 126 of the carriage body 120 can be freely handled in the lateral direction and to the upside in the vertical direction. Therefore, workability is improved.

As described above, according to the image recording apparatus of the present invention, in the carriage body, the flat plane is formed for slidably carrying the ink tubes arranged in the lateral direction and connected to the joint portion. On the other hand, in the carriage cover, the pressing member is provided for slidably pinching a plurality of ink tubes in the lateral direction between the flat plane and itself so as to maintain the arrangement in the lateral direction connected to the joint portion of the plurality of ink tubes. According to the image recording apparatus of the present invention as describe above, the plurality of ink tubes slide on the flat plane in the lateral direction along with the reciprocating motion of the carriage, and smoothly change the posture. In addition, it is prevented that any one of the ink tubes rides on the other ink tube to thereby disturb the arrangement in the lateral direction. Accordingly, the height of the apparatus is suppressed and a thinner apparatus is realized. Further, the workability for connecting the ink tubes to the joint portion of the carriage body is improved.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An image recording apparatus comprising:

an apparatus body;

a recording head for recording an image by ejecting ink droplets to a recording medium that is conveyed in a predetermined conveying direction;

a carriage carrying the recording head thereon and reciprocating inside the apparatus body in a direction crossing the conveying direction; and a plurality of flexible ink tubes, for supplying ink to the recording head, whose one end portions are fixed to the carriage and the other end portions are fixed to a fixing portion of an apparatus body such that the ink tubes extend from the carriage and from the fixing portion in one direction along the reciprocating direction of the carriage and form, at their intermediate portions, a curved portion reversing from one direction to the other direction along the reciprocating direction of the carriage, the carriage including:

a carriage body having: a joint portion to which the plurality of ink tubes are connected in a state of being arranged in a first direction parallel to the conveying direction and the reciprocating direction of the carriage; and a flat plane protruding in an extending direction of the plurality of ink tubes from the joint portion, and carrying extending portions of the plurality of ink tubes from the joint portion slidably in the first direction; and a carriage cover having a pressing member for maintaining an arrangement state of the extending portions of the plurality of ink tubes in the first direction, by pinching the extending portions of the plurality of ink tubes against the flat plane slidably in the first direction.

2. The image recording apparatus as set forth in claim 1, wherein the carriage body has an arm portion, the flat plane is formed by an upper surface of the arm portion, and is exposed on one side of the arm portion in the reciprocating direction of the carriage, and the joint portion is disposed on the upper surface of the arm portion on the other side of the arm portion in the reciprocating direction of the carriage.

3. The image recording apparatus as set forth in claim 1, wherein the plurality of ink tubes extend from the joint portion in the one direction along the reciprocating direction of the carriage, and the pressing member pinches the extending portions of the plurality of ink tubes against the flat plane slidably in a horizontal direction, as the first direction, parallel to the conveying direction that is perpendicular to the reciprocating direction of the carriage.

4. The image recording apparatus as set forth in claim 1, further comprising a regulating wall, formed in at least one of the carriage body and the carriage cover, for restricting a sliding range of an outermost ink tube among the plurality of ink tubes at either of opposite sides of the flat plane in the conveying direction.

5. The image recording apparatus as set forth in claim 4, wherein the other end portions of the plurality of ink tubes are fixed to the fixing portion of the apparatus body in a state of being arranged in a second direction crossing the first direction, and the plurality of ink tubes change a state between a state of being arranged in the first direction and a state of being arranged in the second direction, while being curved at the intermediate portions.

6. The image recording apparatus as set forth in claim 5, wherein the one end portions of the plurality of ink tubes are connected to the joint portion in a state of being arranged in a horizontal direction as the first direction, and the other end portions of the plurality of ink tubes are fixed to the fixing portion in a state of being arranged in a vertical direction, as the second direction, perpendicular to the horizontal direction.

7. The image recording apparatus as set forth in claim 5, further comprising a support member for supporting the intermediate portions of the plurality of ink tubes, the support member including:

an annular portion through which the plurality of ink tubes pass in a state of being arranged in the second direction; and an arm which is supported rotatably along a plane parallel to the first direction about a rotation axis provided in the vicinity of the fixing portion of the apparatus body, the annular portion being provided at an upper side of one end of the arm opposite from the other end near the rotation axis;

wherein the plurality of ink tubes extending between the annular portion and the fixing portion of the apparatus body are prevented from hanging down by being supported by the arm.

8. The image recording apparatus as set forth in claim 7, further comprising:

a guide plate provided at a side closer to an outside of the apparatus body more than the rotation axis of the arm, and having a convexly curved shape toward the outside of the apparatus body; and a wall-shaped regulating member provided at a side further closer to the outside of the apparatus body more than the guide plate, in parallel to the reciprocating direction of the carriage, wherein the ink tubes pass between the guide plate and the regulating member and pass through the annular portion of the support member, and a posture change of the plurality of ink tubes in accordance with a reciprocating motion of the carriage is regulated by the guide plate and the regulating member.

9. The image recording apparatus as set forth in claim 8, further comprising a flat cable for transmitting electric signals between the apparatus body and the carriage, wherein the flat cable is prevented from hanging down by being passed between the guide plate and the regulating member and being supported by the arm of the support member.

10. The image recording apparatus as set forth in claim 1, wherein the other end portions of the plurality of ink tubes are fixed to the fixing portion of the apparatus body in a state of being arranged in a second direction crossing the first direction, and the plurality of ink tubes change a state between a state of being arranged in the first direction and a state of being arranged in the second direction, while being curved at the intermediate portions.

11. The image recording apparatus as set forth in claim 10, wherein the one end portions of the plurality of ink tubes are connected to the joint portion in a state of being arranged in a horizontal direction as the first direction, and the other end portions of the plurality of ink tubes are fixed to the fixing portion in a state of being arranged in a vertical direction, as the second direction, perpendicular to the horizontal direction.

12. The image recording apparatus as set forth in claim 10, further comprising a support member for supporting the intermediate portions of the plurality of ink tubes, the support member including:

an annular portion through which the plurality of ink tubes pass in a state of being arranged in the second direction; and an arm which is supported rotatably along a plane parallel to the first direction about a rotation axis provided in the vicinity of the fixing portion of the apparatus body, the annular portion being provided at an upper side of one end of the arm opposite from the other end near the rotation axis;

wherein the plurality of ink tubes extending between the annular portion and the fixing portion of the apparatus body are prevented from hanging down by being supported by the arm.

13. The image recording apparatus as set forth in claim 12, further comprising:

a guide plate provided at a side closer to an outside of the apparatus body more than the rotation axis of the arm, and having a convexly curved shape toward the outside of the apparatus body; and a wall-shaped regulating member provided at a side further closer to the outside of the apparatus body more than the guide plate, in parallel to the reciprocating direction of the carriage, wherein the ink tubes pass between the guide plate and the regulating member and pass through the annular portion of the support member, and a posture change of the plurality of ink tubes in accordance with a reciprocating motion of the carriage is regulated by the guide plate and the regulating member.

14. The image recording apparatus as set forth in claim 13, further comprising a flat cable for transmitting electric signals between the apparatus body and the carriage, wherein the flat cable is prevented from hanging down by being passed between the guide plate and the regulating member and being supported by the arm of the support member.

* * * * *